US009164459B2

(12) United States Patent
Suzuki

(10) Patent No.: US 9,164,459 B2
(45) Date of Patent: Oct. 20, 2015

(54) IMAGE FORMING APPARATUS

(75) Inventor: Hideaki Suzuki, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/234,651

(22) Filed: Sep. 16, 2011

(65) Prior Publication Data

US 2012/0070165 A1 Mar. 22, 2012

(30) Foreign Application Priority Data

Sep. 22, 2010 (JP) ..... 2010-212313

(51) Int. Cl.
*G03G 15/08* (2006.01)
*G03G 15/00* (2006.01)

(52) U.S. Cl.
CPC ..... *G03G 15/556* (2013.01); *G03G 2215/0129* (2013.01); *G03G 2215/0838* (2013.01)

(58) Field of Classification Search
CPC ..... G03G 15/556; G03G 15/0824; G03G 15/0848; G03G 15/0849
USPC ..... 399/27, 29, 44, 53
See application file for complete search history.

(56) References Cited

U.S. PATENT DOCUMENTS

| | | | |
|---|---|---|---|
| 6,501,916 | B2 | 12/2002 | Suzuki |
| 7,010,237 | B2 | 3/2006 | Suzuki et al. |
| 7,013,096 | B2 | 3/2006 | Ozawa et al. |
| 7,027,746 | B2 | 4/2006 | Suzuki et al. |
| 7,092,647 | B2 | 8/2006 | Suzuki |
| 7,317,889 | B2 | 1/2008 | Suzuki |
| 7,512,348 | B2 | 3/2009 | Suzuki et al. |
| 7,856,199 | B2 | 12/2010 | Tomizawa |
| 7,917,066 | B2 | 3/2011 | Ootsuka |

(Continued)

FOREIGN PATENT DOCUMENTS

| | | | |
|---|---|---|---|
| CN | 101592899 | A | 12/2009 |
| JP | 5-333691 | A | 12/1993 |

(Continued)

OTHER PUBLICATIONS

Noguchi et al., JP 2009-093072 A, Apr. 2009, JPO Machine Translation; Arai, JP 2001-201897 A, Jul. 2001, JPO Machine Translation.*

(Continued)

*Primary Examiner* — Erika J Villaluna
(74) *Attorney, Agent, or Firm* — Fitzpatrick, Cella, Harper & Scinto

(57) ABSTRACT

An image forming apparatus includes an image bearing member for bearing a image; a developing container for accommodating a developer comprising toner and carrier; a rotatable developer carrying member, provided in an opening of the developing container, for developing an electrostatic latent image formed on the image bearing member; a feeding device for feeding the developer in the developing container toward the developer carrying member; detecting device for detecting information relating to a consumption amount of the developer; and a controller for executing, when a image formation is continuously effected for a plurality of recording materials, a operation in a mode in which on the basis of a result of detection of the detecting device, the image forming operation is interrupted, and a operating condition of at least one of the feeding device and the developer carrying member is changed.

17 Claims, 15 Drawing Sheets

(56) References Cited

U.S. PATENT DOCUMENTS

| | | | | |
|---|---|---|---|---|
| 2009/0232531 | A1* | 9/2009 | Tonohiro et al. | 399/53 |
| 2009/0297229 | A1 | 12/2009 | Tomizawa | |
| 2010/0098447 | A1 | 4/2010 | Ootsuka | |
| 2011/0052221 | A1 | 3/2011 | Hirobe et al. | |
| 2011/0142465 | A1 | 6/2011 | Ootsuka | |

FOREIGN PATENT DOCUMENTS

| | | | |
|---|---|---|---|
| JP | 2001-201897 | A | 7/2001 |
| JP | 2007-79480 | A | 3/2007 |
| JP | 2009-93072 | A | 4/2009 |
| JP | 2010-101980 | A | 5/2010 |
| JP | 2010-152098 | A | 7/2010 |

OTHER PUBLICATIONS

Notification of the First Office Action dated Dec. 4, 2012, in Chinese Application No. 201110282787.1.

* cited by examiner

IMAGE FORMING APPARATUS

FIELD OF THE INVENTION AND RELATED ART

The present invention relates to an image forming apparatus such as a copying machine, a printer, a recording image displaying apparatus, a facsimile machine, and the like, which has a developing device which develops an electrostatic latent image formed on the image bearing member of the apparatus, with the use of an electrophotographic method, an electrostatic recording method, or the like, into a visible image, in particular, a developing device structured to use two-component developer made up of toner and carrier.

Generally speaking, an electrophotographic image forming apparatus has: a photosensitive member as an image bearing member which is in the form of a drum; a charging device; an exposing device; a developing device; a transferring device; and a fixing device. Its image forming operation is as follows: First the peripheral of the photosensitive drum is uniformly charged by the charging device. Then, an electrostatic latent image is formed on the uniformly charged portion of the peripheral of the photosensitive drum by exposing the uniformly charged portion by the exposing device according to image formation data. Then, the electrostatic latent image on the peripheral is developed by the developing device into a visible image, that is, an image formed of toner, with the use of toner as developer. Then, the visible image on the photosensitive drum is transferred onto a sheet of recording medium by the transferring device. Next, the toner image on the sheet of recording medium is fixed (welded) to the sheet of recording medium by the heat and pressure applied to the sheet of recording medium and the toner image thereon by the fixing device.

Some developing devices used for developing an electrostatic latent image as described above use a two-component developer, that is, a developer made up of nonmagnetic toner as actual developer, and magnetic carrier. Two-component developer does not require that toner particles contain a magnetic substance. Therefore, an image formed by a color image forming apparatus which has developing devices which use two-component developer is superior in terms of image tone than an image formed by a color image forming apparatus which has developing devices which use single-component developer. Therefore, a developing device which uses two-component developer has been widely used in the field of a color image forming apparatus. A developing device which uses two-component developer conveys the two-component developer in its developer chamber to its development roller while stirring the developer. Then, it places the developer on the peripheral of its development sleeve. Then, it regulates in amount the body of developer on the peripheral of the development sleeve, with its blade as a developer amount regulating member. Then, it applies development bias between the development sleeve and photosensitive drum. As a result, only the toner in the body of two-component developer on the peripheral surface of the development roller transfers onto the peripheral of the photosensitive drum in the pattern of the electrostatic latent image on the photosensitive drum, effecting a visible image, that is, an image formed of toner (which hereafter will be referred to simply as toner image), which reflects the pattern of the electrostatic latent image.

In recent years, in the field of an image forming apparatus such as a copying machine, a printer, etc., it has come to be strongly desired to reduce the main assembly of an image forming apparatus in size for the sake of special efficiency. This desire has become even stronger in the field of a full-color image forming apparatus, because a full-color image forming apparatus employs multiple developing devices, being therefore greater in size than a monochromatic image forming apparatus. There have been known a few types of developing device which can contribute to the size reduction of the main assembly of an image forming apparatus (one of them is disclosed in Japanese Laid-open Patent Application H05-333691, for example).

In the case of a typical developing device of this type, it has a developer stirring chamber and a development chamber, in which two-component developer is conveyed while being stirred. The developer stirring chamber and development chamber are vertically stacked. Both chambers are provided with a screw as a developer conveying means. That is, the developing device shell in which the two-component toner is stored has two chambers. One is the stirring chamber and the other is the development chamber. The two chambers are vertically stacked, with the presence of a pair of developer passages between the two chambers. Thus, the two-component developer in the developing device shell is circulated between the two chambers through the pair of passages while being stirred by the developer conveyance screw in each chamber. More specifically, a fresh supply of two-component developer is delivered into the stirring chamber, and is conveyed to the upward developer passage while being stirred and mixed with the body of developer which was in the chamber. Then, the mixture is sent upward into the development chamber, which is directly above the stirring chamber. In the development chamber, that is, the top chamber, the developer is placed on the peripheral of the development sleeve while being conveyed toward the downward developer passage, while being stirred. The developer on the development sleeve develops the electrostatic latent image on the peripheral surface of the photosensitive drum while it is moved through the gap between the photosensitive member and development sleeve by the rotation of the development sleeve. Thereafter, the developer remaining on the development sleeve is returned to the stirring chamber, that is, the bottom chamber.

In the case of a developing device of the so-called vertical circulation type, such as the above-described one, which vertically circulates developer, its development chamber and stirring chamber are vertically stacked. Therefore, it is advantageous in that it is smaller in footprint. Thus, the employment of a developing device of the so-called vertical circulation type can reduce in size even a color image forming apparatus of the tandem type, in which multiple developing devices are horizontally arranged in tandem.

By the way, an image forming operation in which a substantial number of images which are low in image ratio are continuously printed is small in toner consumption. Therefore, the toner in the developing device which uses two-component developer is unlikely to be replaced by a fresh supply of toner, and therefore, is likely to deteriorate before it is replaced by a fresh supply of toner. Here, "toner deterioration" means that the external additive particles are buried in the toner particles by stress. As toner deteriorates, the developer reduces in fluidity, reducing thereby in the efficiency with which it can be conveyed by the toner conveyance screw. That is, it becomes difficult for the developer to be conveyed by the screw.

Further, it has been known that in an image forming operation, the main assembly of an image forming apparatus increases in temperature, which in turn increases the ambient temperature of the developing device. As the ambient temperature of the developing device increases, the developer in the developing device reduces in fluidity. More specifically, the lower in melting point the toner, the greater the amount by which the toner reduces in fluidity. As the toner in two-component developer reduces in fluidity, the developer itself reduces in fluidity, reducing thereby in the efficiency with which it is conveyed by a developer conveyance screw.

As described above, as a substantial number of images which are low in image ratio are printed, and/or the ambient temperature of a developing device increases, the developer in the developing device reduces in the efficiency with which it is conveyed by the developer conveyance screw in the developing device. This phenomenon is particularly noticeable in a case where a number of images to be formed are very large. In an ordinary image forming operation, a development sleeve and a developer conveyance screw are rotated even during image intervals (recording sheet intervals), regardless of the number of prints to be made. In other words, in an ordinary image forming operation, a development sleeve and a developer conveyance screw are continuously rotated until the end of the image forming operation. Further, the top surface of the body of developer in a developing device remains higher while the developer is conveyed by the developer conveyance screw in the developing device (screw is rotated), whereas it remains lower while the developer conveyance screw is not conveyed by the screw (screw is not rotated). Moreover, the top surface of the body of developer in a developing device is affected in height by whether or not the developer is being conveyed (moved) by the development sleeve (whether or not sleeve is rotated).

While images are continuously printed, the development sleeve and developer conveyance screw are not turned on or off, and therefore, the top surface β (FIG. 14) does not change in height. In other words, while images are continuously printed, the development flow in a developing device remains steady. However, as the development flow remains steady, the following problem occurs. That is, as the development flow remains steady, it is likely for a stationary layer α of developer to form in the areas of the developing device, such as the area between the developer conveyance screw and developing device shell 22, in which the developer is less likely to be affected by the rotation of the developer conveyance screw. The formation of a stationary layer α of developer reduces the amount by which the developer is conveyed in the developing device shell 22, which in turn is likely to cause an image forming apparatus to output images which are nonuniform in density.

In particular, in the case of a developing device of the so-called vertical circulation type, the top surface of the body of developer in the developing device is likely to become tilted relative to the developer conveyance direction, as shown in FIG. 15. Therefore, as the amount by which developer is conveyed in the developing device reduces, the portion of the development sleeve, which corresponds to the portion of the development chamber indicated by an X mark in FIG. 15, is likely to be insufficiently supplied with developer, and therefore, is likely to fail to be fully coated with developer. More concretely, in the development chamber 23, that is, the top chamber of the developing device, the body of developer is partially supplied to the development sleeve while being conveyed by the developer conveyance screw 26 in the lengthwise direction of the screw 26. As for the developer borne on the development sleeve is conveyed through the development area, and then, is recovered in to the stir chamber 24, that is, the bottom chamber of the developing device, and then, is conveyed by the developer conveyance screw 25. In the development chamber 23, therefore, the more downstream in the development chamber 23 in terms of the developer conveyance direction, the smaller the amount by which the developer is conveyed by the developer conveyance screw 26. On the other hand, in the stir chamber 24, the more downstream in terms of the developer conveyance direction, the greater the amount by which the developer is conveyed by the developer conveyance screw 25, because of the developer recovered into the stir chamber 24 from the development sleeve. This is why the top surface of the body of developer in the development chamber 23 and that in the stir chamber 34, in a developing device of the vertical circulation type, are likely to become tilted as shown in FIG. 15.

As described above, in the case of a developing device of the vertical stir circulation type, the formation of a stationary layer of developer is likely to reduce the amount by which the developer is conveyed in the developing device. As the amount by which the developer is conveyed reduces, it becomes impossible for the portion of the development sleeve, which corresponds to the portion of the development chamber 23 indicated by the X mark (where top surface of body of developer is lowest), to be fully supplied with the developer. Therefore, it is possible for this portion of the development sleeve to fail to be fully coated with the developer. If a given portion of the development sleeve fails to be fully coated with the developer, the portion of the electrostatic latent image on the photosensitive drum, which corresponds in position to the given portion of the development sleeve, is not properly developed. Consequently, the image forming apparatus outputs a defective image.

SUMMARY OF THE INVENTION

Thus, the primary object of the present invention is to provide an image forming apparatus which outputs excellent images even under the condition in which a stationary layer of developer is likely to form.

According to an aspect of the present invention, there is provided an image forming apparatus comprising an image bearing member for bearing a image; a developing container for accommodating a developer comprising toner and carrier; a rotatable developer carrying member, provided in an opening of said developing container, for developing an electrostatic latent image formed on said image bearing member; feeding means for feeding the developer in said developing container toward said developer carrying member; detecting means for detecting information relating to a consumption amount of the developer; and a controller for executing, when a image formation is continuously effected for a plurality of recording materials, a operation in a mode in which on the basis of a result of detection of said detecting means, the image forming operation is interrupted, and a operating condition of at least one of said feeding means and said developer carrying member is changed.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

Figure 1:
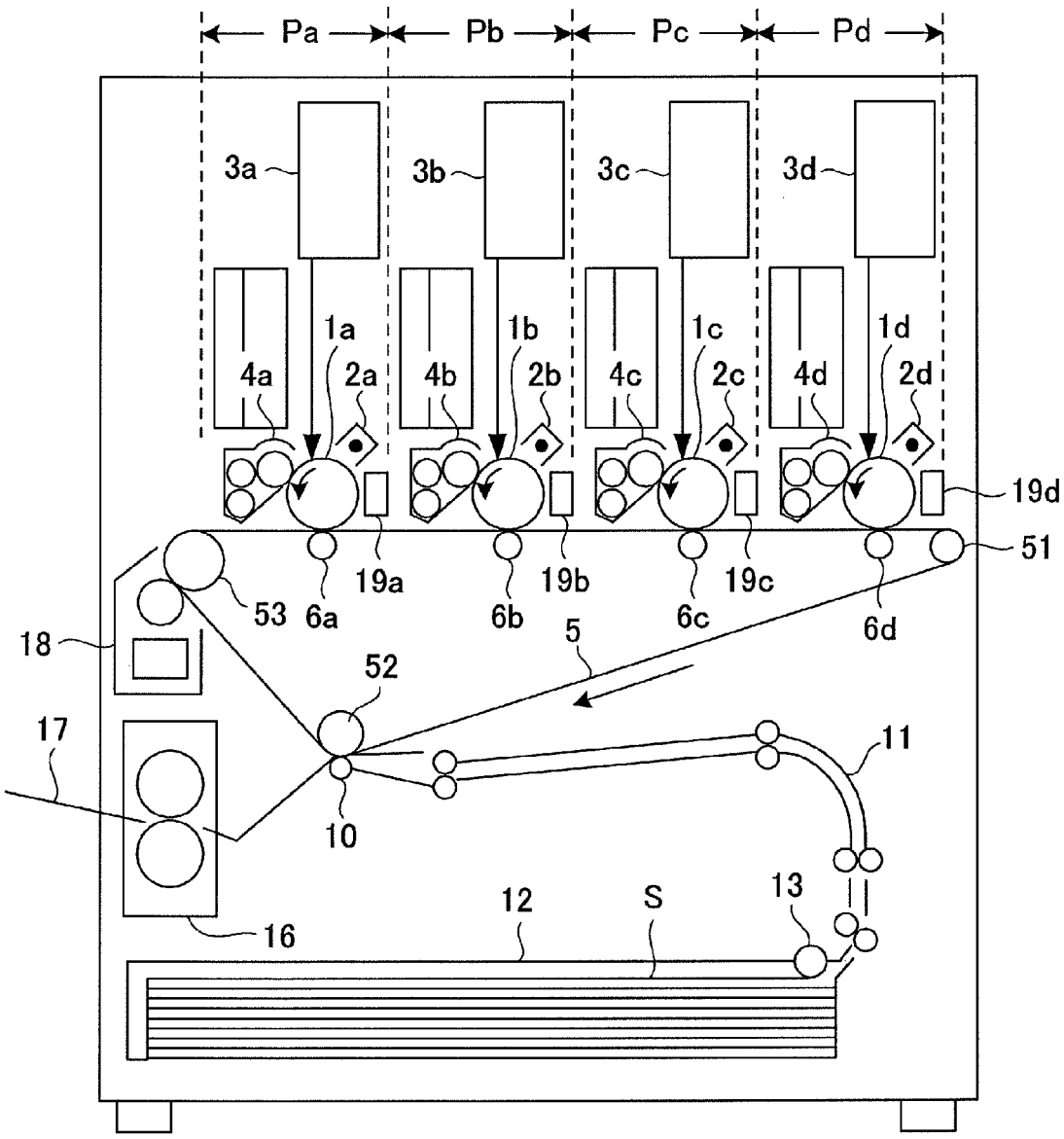
FIG. 1 is a schematic sectional view of the image forming apparatus in the first preferred embodiment of the present invention. It describes the general structure of the apparatus.

Next, referring to FIGS. 1-7, the first preferred embodiment of the present invention is described. First, referring to FIG. 1, the general structure of the image forming apparatus in this embodiment is described.

[Image Forming Apparatus]

The image forming apparatus in this embodiment is a full-color image forming apparatus which uses one of the electrophotographic image forming methods. It has four image formation stations P (Pa, Pb, Pc, and Pd). The four image formation stations P are virtually the same in structure, although they are different in the developer color. Thus, the structure of only one of the image formation stations P is described. In the following description of the structure of the image forming stations P, the suffixes a, b, c, and d, which indicate the specific developing devices, one for one, are not used unless they need to be used to differentiate one station from the other.

The image formation station P has an electrophotographic photosensitive member as an image bearing member, on which an image formed of toner is borne. The photosensitive member is in the form of a drum, and is rotated in the direction (counterclockwise direction) indicated by an arrow mark. The image formation station P has also an image forming means made up of a charging device 2, a laser beam scanner 3 (exposing means), a developing device 4, a transfer roller 6, a cleaning means 19, etc., which are in the adjacencies of the peripheral of the photosensitive drum 1.

Next, the image formation sequence which is carried out by the image forming apparatus structured as described above when the apparatus is in the normal mode is described. First, the peripheral surface of the photosensitive drum 1 begins to be uniformly charged by the charging device 2. In the normal mode, the photosensitive drum 1 is rotated in the clockwise direction indicated by an arrow mark at a process speed (peripheral velocity) of 286 mm/sec, for example. As the photosensitive drum 1 is rotated, the uniformly charged portion of the peripheral surface of the photosensitive drum 1 is exposed to (scanned by) the laser beam scanner: it is exposed to (scanned by) a beam of laser light emitted by the laser beam scanner while being modulated with the image formation signals.

More specifically, the laser beam scanner 3 has a semiconductor laser, which is in the scanner 3. The laser beam scanner 3 is controlled based on the data of the image to be formed. That is, the semiconductor laser emits a beam of laser light while modulating the beam with electrical signals which reflect the image data, which are inputted from an image reader having a photoelectric element such as a CCD, or electrical signals which reflect the information of the image to be formed, and which are inputted through the external input terminal of the image forming apparatus. As a given point of the uniformly charged portion of the peripheral of the photosensitive drum 1 is exposed to the beam of laser light, it reduces in potential. As a result, an electrostatic latent image is effected on the peripheral of the photosensitive drum 1. In this embodiment, the combination of the charging device 2 and laser beam scanner makes up a means for forming an electrostatic latent image.

The electrostatic latent image formed through the process described above is developed in reverse by the developing device 4 into a visible image, that is, an image formed of toner. The developing device 4 in this embodiment uses a developing method which uses two-component, that is, a developing method which uses developer made of toner and carrier. Each of the developing devices 4*a*, 4*b*, 4*c*, and 4*d* contains two-component developer which is made up of carrier, and a toner which is different in color from the toners in the other developing devices. More concretely, the developers for the developing devices 4*a*, 4*b*, 4*c*, and 4*d* contain yellow (Y), magenta (M), cyan (C), and black (K) toners, respectively. Thus, as the above-described image formation sequence is carried out in each of the image formation stations Pa, Pb, Pc, and Pd, four toner images, that is, yellow, magenta, cyan, and black toner images, are formed on the peripheral of the photosensitive drums 1*a*, 1*b*, 1*c*, and 1*d*, respectively.

Further, the image forming apparatus has an intermediary transfer belt 5 as an intermediary transferring member, which extends under the image formation stations Pa, Pb, Pc, and Pd in the direction in which the image formation stations P are aligned in tandem. The intermediary transferring member 5 is suspended by rollers 51, 52, and 53. It is circularly moveable in the direction indicated by an arrow mark. The four toner images on the photosensitive drums 1, one for one, are sequentially transferred by the transfer roller 6 onto the intermediary transferring member 5 as the image transferring intermediary member, so that the four toner images, that is, the yellow, magenta, cyan, and black toner images are layered on the intermediary transferring member 5, whereby a full-color toner image is effected on the intermediary transferring member 5. The toner which failed to transfer from the photosensitive drum 1 onto the intermediary transferring member 5, and therefore, is remaining on the photosensitive drum 1 is recovered by the cleaning means 19.

Meanwhile, a sheet S of recording medium such as a sheet of paper is taken out of a sheet feeder cassette 12 by a sheet feeder roller 13, and is conveyed to the nip between the intermediary transferring member 5 and a secondary transfer roller 10 as the image transferring secondary member, through a sheet guide 11. Then, the sheet S is conveyed through the nip. As the sheet S is conveyed through the nip, the full-color image on the intermediary transferring member 5 is transferred onto the sheet S by the function of the second transfer roller 10. The toner which failed to transfer from the intermediary transferring member 5 onto the sheet S, and therefore, is remaining on the intermediary transferring member 5, is recovered by the cleaning means 18 for cleaning the intermediary transferring member 5. After the transfer of the full-color toner image onto the sheet S, the sheet S is sent to a fixing device 16 (thermal fixing device), in which the full-color image on the sheet S is fixed to the sheet S. Then, the sheet S is discharged into a delivery tray 17.

The image bearing member in this embodiment is the photosensitive drum 1, which is an ordinary organic photosensitive member. Obviously, however, an inorganic photosensitive member such as a photosensitive member based on amorphous silicon or the like may be used in place of the photosensitive drum 1. Further, the photosensitive member may be in the form of a belt. Moreover, it is not mandatory that the charging method, transferring method, cleaning method, and fixing method are limited to those described.

[Developing Device]

Figure 2:
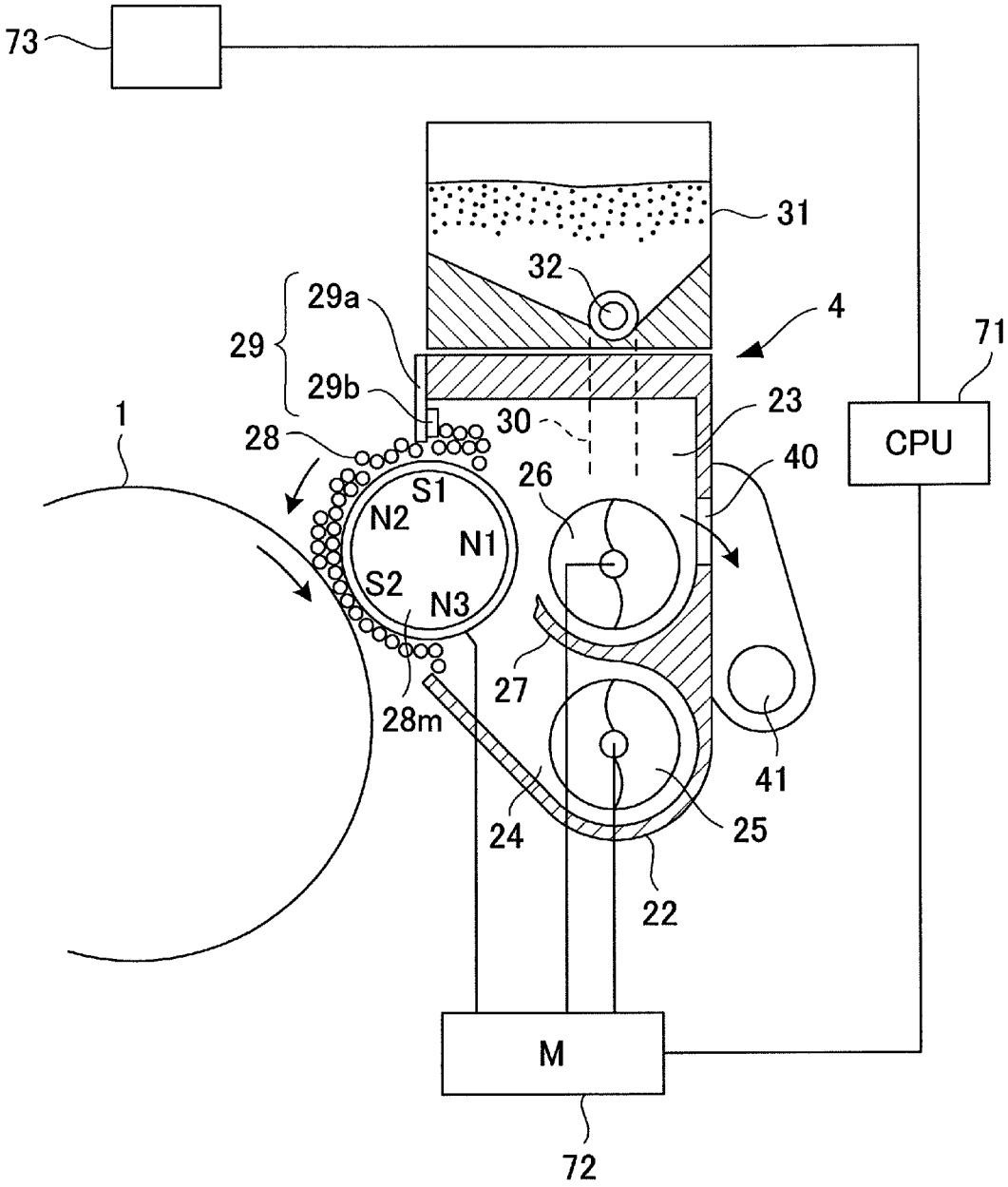
FIG. 2 is a schematic sectional view of the developing device in the first preferred embodiment of the present invention. It describes the general structure of the device.
Figure 3:
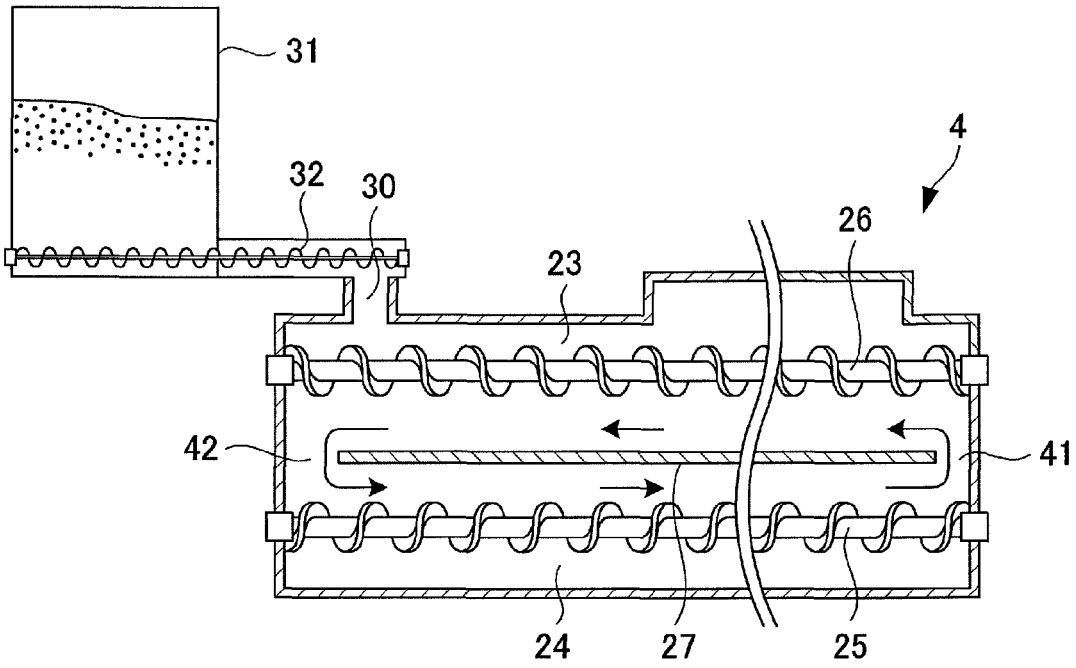
FIG. 3 is a schematic sectional view of the developing device shown in FIG. 2, at a vertical plane which coincides with the axial line of one of the developer conveyance screws of the developing device.

Next, referring to FIGS. 2 and 3, the developing device 4 is described. The developing device 4 has: a shell 22 in which the two-component developer is stored; a development sleeve 28 as a developer bearing member; and developer conveying first and second screws 25 and 26 as developer conveying members. The developing device 4 in this embodiment is of the so-called vertical circulation type. More specifically, it has: a development chamber 23 which is the primary developer chamber; a developer stirring chamber 24 which is the secondary developer chamber; and a partitioning wall 27 which separates the two chambers 23 and 24 by extending between the two chambers 23 and 24 in the direction perpendicular to FIG. 2. That is, the development chamber 23 is on top of the developer stirring chamber 24 (which hereafter is referred to simply as stirring chamber 24). Normally, the developer is in both the development chamber 23 and stirring chamber 24.

There are the developer conveying first and second screws 25 and 26 in the stirring chamber 24 and development chamber 23, respectively. The developer conveying second screw 26 (developer conveying first member) is in the bottom portion of the development chamber 23 (top chamber: first chamber for developer), and is roughly parallel to the axial line of the development sleeve 28. It conveys the developer in the development chamber 23 in one direction which is parallel to the axial line of the development sleeve 28 while stirring the developer. The developer conveying first screw 25 (developer conveying first member) is in the bottom portion of the stirring chamber 24 (bottom chamber: second chamber for developer), and is roughly parallel to the developer conveying first screw 25. It conveys the developer in the stirring chamber 24 in the direction opposite to the direction in which the developer conveying second screw 26 conveys the developer, while stirring the developer. Further, the developing device shell 22 has openings 41 and 42 (passages), which are at the lengthwise ends of the partitioning wall 27. Thus, as the developer is conveyed by the rotation of the developer conveying first and second screws 25 and 26 as described above, the developer in the developing device 4 is circulated in the developing device 4 in such a manner that the developer in the development chamber 23 is moved into the stirring chamber 24, whereas the developer in the stirring chamber 24 is moved into the development chamber 23 through the openings 42 and 41, respectively. The developer conveying first screw 25 is 20 mm in external diameter, 6 mm in shaft diameter, 25 mm in pitch, and 650 rpm in rotational speed, for example. As for the developer conveying second screw 26, it is 20 mm in external diameter, 6 mm in shaft diameter, 25 mm in pitch, and 680 rpm in rotational speed, for example.

Further, the developing device shell 22 has an opening, which corresponds in position to the development area, which is between the photosensitive drum 1 and development sleeve 28. It is through this opening that the development sleeve 28 is exposed from the developing device shell 22 and opposes the peripheral of the photosensitive drum 1. As the development sleeve 28 is rotated, it bears the developer in the developing device shell 22 and conveys the developer to the development area, that is, the area between the peripheral of the photosensitive drum 1 and the peripheral of the development sleeve 28. As the developer (two-component developer) is borne on the peripheral of the development sleeve 28, it is made to crest by one of the magnetic poles of the magnet in the development sleeve 28. The crest is controlled in height (amount) by a blade 29 for regulating the developer on the peripheral of the development sleeve 28. It is assumed here that the development sleeve 28 and photosensitive drum 1 are 20 mm and 40 mm, respectively, in diameter, for example, and also that the shortest distance between the peripheral of the development sleeve 28 and the peripheral of the photosensitive drum 1 is roughly 380 μm, for example. Thus, the magnetic brush on the peripheral of the development sleeve 28, the height of which is under the control of the blade 29, is moved into the development area, in which it develops the electrostatic latent image on the peripheral of the photosensitive drum 1 by coming into contact with the peripheral of the photosensitive drum 1.

The development sleeve 28 is made of a nonmagnetic substance such as aluminum and stainless steel. There is a magnetic roller **28*m* in the hollow of the development sleeve 28. The magnetic roller 28*m* is a means for providing a magnetic field. It is stationary. It has multiple magnetic poles, including a development pole S2, which corresponds in position to the development area, that is, the area in which the development sleeve 28 opposes the photosensitive drum 1. The magnetic roller 28*m* has also: a magnetic pole S1 which corresponds in position to the blade 29; a magnetic pole S1; a magnetic pole N1 which is between the magnetic poles S1 and S2; a magnetic pole N2 which corresponds in position to the development chamber 23; and magnetic pole N3 which corresponds in position to the stirring chamber 24. As for the speed at which the development sleeve 28 is rotated during an image forming operation (speed at which electrostatic latent image is developed), it is 492 rpm (which is equivalent to 180% in peripheral velocity ratio relative to photosensitive drum 1**), for example.

That is, the development sleeve 28 internally holds the magnetic roller **28*m*, and is rotated in the direction (counterclockwise direction) indicated by an arrow mark. As it is rotated, it bears the developer and conveys the developer to the development area. More specifically, as the development sleeve 28 is rotated, the body of developer on the peripheral of the development sleeve 28 is regulated in thickness by the regulation blade 29, and then, is conveyed to the development area, in which the development sleeve 28 opposes the photosensitive drum 1. Thus, the developer on the peripheral of the development sleeve 28 is transferred onto the peripheral of the photosensitive drum 1 in the pattern of the electrostatic latent image on the peripheral of the photosensitive drum 1**; the electrostatic latent image is developed.

The developer regulating blade 29 is made up of a nonmagnetic portion 29*a* and a magnetic portion 29*b*. The nonmagnetic portion 29*a* is a piece of long and narrow plate formed of aluminum or the like, and its lengthwise direction is parallel to the axial line of the development sleeve 28. The magnetic portion 29*b* is a piece of long and narrow plate formed of magnetic substance such as iron or the like, and its lengthwise direction also is parallel to the axial line of the development sleeve 28. The developer regulating blade 29 is on the upstream side of the photosensitive drum 1 in terms of the rotational direction of the development sleeve 28. Thus, as the development sleeve 28 is rotated, the body of two-component developer, that is, the mixture of toner and magnetic carrier, is moved to the development area through the gap between the regulating edge of the developer regulating blade 29 and the peripheral of the development sleeve 28.

The amount by which the developer on the peripheral of the development sleeve 28 is conveyed to the development area is controlled by adjusting the gap between the developer regulating blade 29 and the peripheral of the development sleeve 28. In this embodiment, the amount by which the developer is allowed to remain coated on the peripheral of the development sleeve 28 per unit area is controlled to 30 mg/cm$^2$, for example. More specifically, the gap between the developer regulating blade 29 and the peripheral of the development sleeve 28 is desired to be in a range of 200-1,000 μm, preferably, in a range of 400-700 μm. In this embodiment, it is set to 580 μm.

[Method for Replenishing Developing Device with Developer]

Next, referring to FIGS. 2 and 3, the method for replenishing the developing device 4 in this embodiment with developer is described. The image forming apparatus is provided with a hopper 31 which holds the two-component developer, that is, the mixture of toner and carrier, to be used to replenish the developing device 4 with developer. The hopper 31 is on top of the developing device 4. The hopper 31 which is the means for supplying the developing device 4 with developer has a developer conveying member 32, which is in the form of a screw and is in the bottom portion of the hopper 31. One end of the shaft of the developer conveying member 32 is at the developer exit 30 which is at the front end of the developing device 4.

As the toner in the developing device 4 is consumed by image formation, the developer in the hopper 31 is delivered into the developing device shell 22 through the developer exit 30 of the hopper by the rotation of the developer conveying member 32 and the weight of the developer itself, by the amount equal to the amount by which the developer in the developing device 4 was consumed. That is, the developing device 4 is supplied with the developer from the hopper 31 as described above. The amount by which the developer in the hopper 31 is delivered to the developing device 4 is roughly determined by the revolution of the developer conveying member 32, which is controlled by an unshown means for controlling the toner delivery amount. As for the method for controlling the toner delivery amount, there is a method which optically or magnetically detects the toner density of the two-component developer, a method which forms a referential latent image on the peripheral of the photosensitive drum 1, develops the referential latent image, and detects the density of the resultant toner image, etc. Choice is optional; one of the methods may be chosen as fits.

[Control Sequence]

Figure 4:
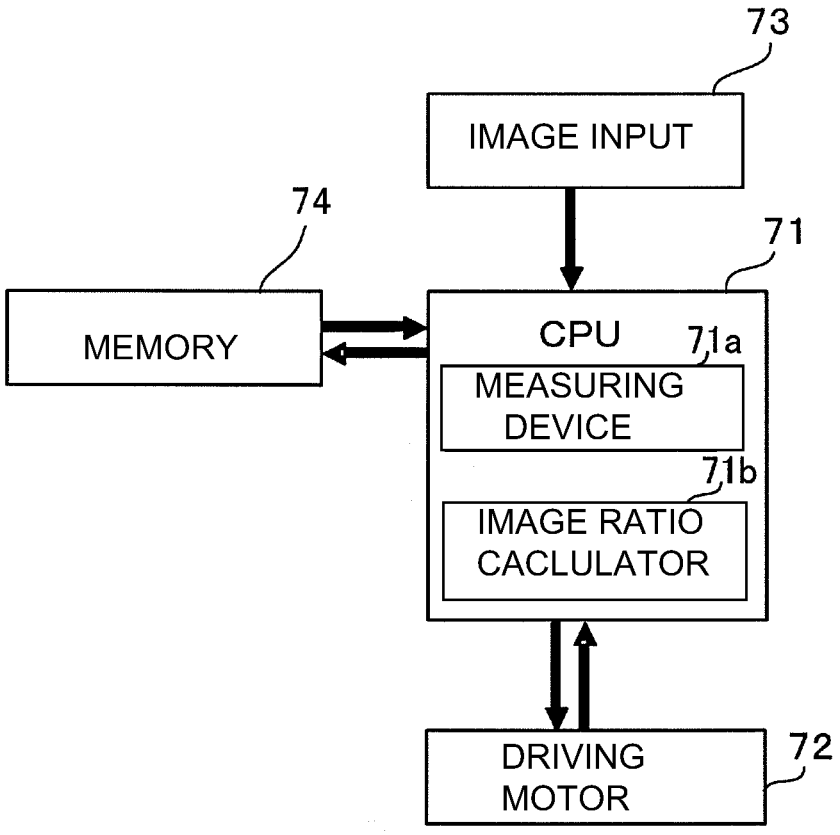
FIG. 4 is a block diagram of the control section of the image forming apparatus.

In this embodiment, the development sleeve 28, developer conveying first screw 25, and developer conveying second screw 26 are driven by the same motor 72, which is under the control of the CPU 71 as the controlling means of the image forming apparatus. Referring to FIG. 4, the CPU 71 has an image ratio computing portion 71*b*, as an image ratio computing means, which successively calculates the average image ratio from the inputted image formation data, per preset number of images formed by the image forming apparatus.

The image data (image data signals) of each of multiple monochromatic images, of which the full-color image to be formed is made are sent to the CPU 71 through an external terminal of a personal computer, or the image data input portion 73 of the scanner of the image forming apparatus. The image data input portion 73 is equivalent to the means for detecting the amount of developer consumption.

The image ratio calculating portion 71 of the CPU 71 successively calculates the image ratio based on this image data (results of detection), stores the calculated image ratio in a memory 74, and calculates the average image ratio based on the accumulated image ratios. Then, the CPU 71 carries out the following control sequence based on the results of the above-described calculations and the length of time measured by a measuring portion 71*a*. That is, if the measured length of time is no less than a preset value, and the average image ratio is no more than a preset value, the CPU 71 carries out the following control sequence. That is, it changes the body of developer in the developing device shell 22 in height by changing the condition under which the development sleeve 28 is driven, and the condition under which one of the developer conveying first and second screws 25 and 26 is driven. More concretely, the CPU 71 stops the driving of the development sleeve 28, and at least one of the developer conveying first and second screws 25 and 26, or reduces them in speed compared to their normal speed for development. This control is carried out each time the cumulative number of formed images reaches a preset value, or each time the cumulative length of time the image forming apparatus is continuously in operation reaches a preset value.

In this embodiment, if the above-described conditions are met, the CPU 71 stops the motor 72. The development sleeve 28 and developer conveying first and second screws 25 and 26 are driven by the same motor (motor 72). Thus, as the motor 72 is stopped, the development sleeve 28 and developer conveying first and second screws 25 and 26 stop together. The timing with which the motor 72 is stopped in this embodiment is while an electrostatic latent image is not developed. That is, it is while the portion of the peripheral surface of the photosensitive drum 1, which corresponds to the interval between the successive two electrostatic latent images (interval between successive two images: recording sheet interval). In other words, it is while the portion of the peripheral surface of the photosensitive drum 1, which corresponds to the interval between the successive two images, is moving through the development area, that the condition under which the motor 72 is driven is changed. In this embodiment, changing the condition under which the motor 72 is driven means stopping the motor 72.

Figure 5:
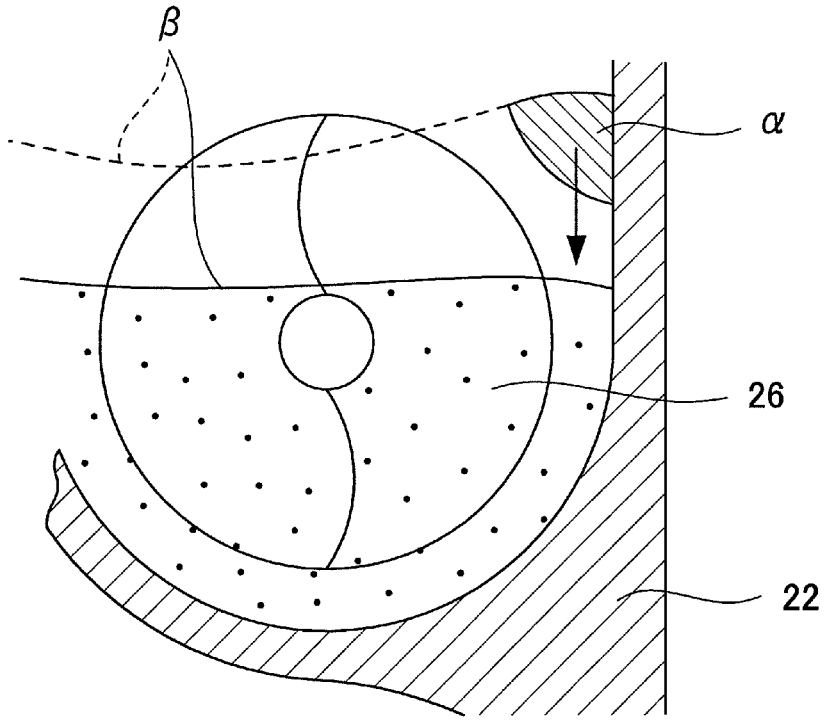
FIG. 5 is an enlarged sectional view of a part of the developing device, at a vertical plane perpendicular to the lengthwise direction of the device. It describes the changes which occur to the surface of the body of developer in the device as the developing device is controlled according to the control sequence in the first preferred embodiment.

Referring to FIG. 5, as the driving of the development sleeve 28 and developer conveying first and second screws 25 and 26 is stopped, the top surface β of the body of developer in the developing device shell 22 lowers (moves from position indicated by broken line to position indicated by solid line). This phenomenon occurs for the following reason. That is, while the developer conveying second screw 26 is driven, the developer is conveyed while being tossed up by the fins of the screw, whereas as the screw 26 stops, the developer is no longer tossed up by the fins, and therefore, the developer settles due to the presence of gravity. As the top surface of the body of developer in the developing device shell 22 lowers, the stationary body α of developer, which is being formed above the screw, collapses and falls, being thereby prevented from growing excessively large.

Next, the above-described control sequence is described in more detail. As an image forming operation is started, the development sleeve 28 and developer conveying first and second screws 25 and 26 begin to be rotated by the motor 72 so that their speeds reach preset values set for image formation (speed for development). As soon as their rotation begins, the measuring portion 71*a* of the CPU 71 begins to successively measure the length of time the motor 72 is continuously rotating at the normal speed for development. The measured length of the continuous rotation of the motor 72 is converted by the CPU 71 into the number of recording sheets of size A4. The dimension of a recording sheet of size A4 in terms of the secondary scan direction is equivalent to 734 ms (when process speed=286 mm/s) of the continuous rotation of the motor 72. Therefore, if the length of time the motor 72 is continuously rotated is 100 seconds, this length of time is equivalent to 136 recording sheets of size A4.

As the means, in this embodiment, for determining the fluidity of the developer, the average image ratio calculated from the video count based on the image data (image information signals) is used. That is, when the amount by which toner is consumed while the development sleeve 28 and developer conveying first and second screws 25 and 26 are rotated is small, the developer in the developing device 4 is hardly replaced. Therefore, the developer in the developing device 4 deteriorates, reducing thereby fluidity. In this embodiment, therefore, in order to determine the amount of toner consumption, the average image ratio is used as the index for determining the developer fluidity in the developing device 4. More specifically, the video count, which is equivalent to the density of picture elements of each image to be formed, is obtained from the data of each image. Then, the image ratio, which is the ratio of the video count relative to the image formation area, is obtained for each image. Then, the image ratios are totaled. Then, the sum of the image ratio is divided by the number of the images formed, to calculate the average image ratio.

More concretely, as a printing operation is started, the image input portion 73 (for example, image scanner (image reader)) separates the image to be formed into monochromatic images of the primary colors, and the image information signals of each monochromatic image of the primary colors are inputted into the CPU 71. Then, the video count of each monochromatic image is obtained based on the inputted image information signals. The method for calculating the average image ratio of a monochromatic image is the same regardless of the color of the monochromatic image. Therefore, only the method for calculating the average image ratio of the yellow monochromatic image is described here.

The image ratio σny of the yellow monochromatic image for the formation of a given full-color image to be formed is calculated from the video count Cvy of the yellow monochromatic image and the maximum video count Cvy-max of the size of the given full-color image:

$$\text{image ratio } \sigma ny = Cvy/Cvy\text{-max}.$$

For example, in a case where the scanner resolution is 600 dpi (dot per inch), and a full-color image of size A4 is formed at 256 in gradation, the maximum video count per sheet is $8874\times10^6$. The calculated image ratio of the yellow monochromatic image for each of the full-color images is successively and cumulatively stored in the memory 74. Then, the moving average value σyAve per a preset number (500 for example) of recording sheets is calculated from the accumulated (total) image ratio of the yellow monochromatic image in the memory 74, with the use of the following equation. The thus obtained value is used as the average image ratio. The value number preset for the number of recording sheets to obtain the average image ratio does not need to be limited to 500. For example, it may be such a value that corresponds to the timing (intervals in terms of recording sheet count) with which the driving of the motor 72 is stopped (200 sheets in this embodiment). "A preset number of recording sheets" means that an image formation sequence is repeated a preset number of times. Thus, in a case where the preset number of recording sheets is 500, an image forming sequence is repeated 500 times:

$$\sigma yAve = \{\sigma(n-499)y + \sigma(n-498)y + \sigma(n-497)y + \ldots + \sigma(n-1)y + \sigma ny\}/500.$$

Figure 6:
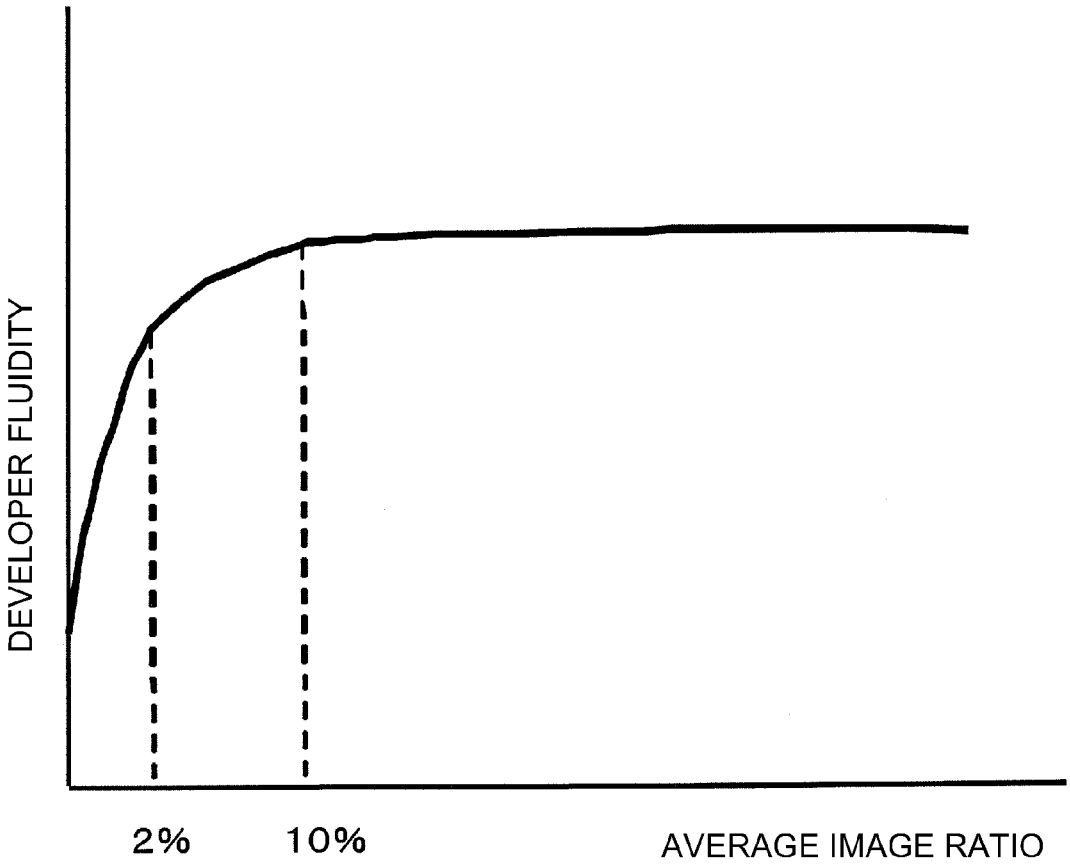
FIG. 6 is a graph which shows the relationship between the average image ratio and developer fluidity.

As described above, the developer reduces in fluidity when a substantial number of images which are low in image ratio are continuously printed. More specifically, the formation of an image which is low in image ratio is low in toner consumption. Therefore, when a substantial number of images which are low in image ratio are continuously printed, the average image ratio is low. The lower the average image ratio, the lower the developer becomes in fluidity. FIG. 6 shows the relationship between the average image ratio and developer fluidity, which was obtained through the experiments carried out by the inventors of the present invention with the use of the developing device in this embodiment. As is evident from FIG. 6, as a substantial number of images which were no more than 2% (preset value) in average image ratio were continuously printed, the developer drastically reduced in fluidity, and a certain amount of developer in the developing device 4 was likely to become stationary.

The statement that an image forming operation in which an image formation sequence is repeated a preset number of times (preset number of prints are made) is no more than a preset value in average image ratio means that the amount of toner consumed by this image forming operation is no more than a preset value. The amount by which toner is consumed by an image forming operation in which the image formation sequence is repeated a preset number of times can be obtained from the average image ratio of the operation, and the number of images formed, that is, the number of times the image formation sequence is repeated. In other words, there is a correlation between the average image ratio of an image forming operation in which the image formation sequence is repeated a preset number of times, and the amount by which toner is consumed by the image forming operation.

Table 1 shows the results of the experiments carried out by the inventors of the present invention with the use of the developing device structured and controlled like the one in this embodiment. In the experiments, images which are no more than 2% in average image ratio were continuously printed, and the image forming operation was interrupted with preset timings. Table 1 shows the relationship between the timing of the interruptions, and formation of stationary body of developer, occurrence of the phenomenon that a part or parts of the development sleeve failed to be fully coated, and productivity (throughput). In Table 1, "G" indicates that the formation of a stationary body of developer did not occur; the development sleeve was fully coated; or the developing device was satisfactory in productivity. An "N" indicates that stationary bodies of developer were formed; the development sleeve failed to be fully coated; or the image forming apparatus was significantly low in productivity. Further, "F" indicates that a small number of stationary bodies of developer were formed.

TABLE 1

| | Drive stop For every | | | | | | |
|---|---|---|---|---|---|---|---|
| | 50 sheets | 100 sheets | 200 sheets | 300 sheets | 400 sheets | 500 sheets | No |
| Stationary layer | G | G | G | G | F | N | N |
| Prevention Of coating failure | G | G | G | G | G | N | N |
| Through-put | N | N | G | G | G | G | G |

As will be evident from Table 1, the formation of the stationary bodies of developer became conspicuous as the image intervals (sheet intervals) with which the driving of the motor 72 is stopped was increased to 400 sheets of recording medium, and it became more conspicuous as the intervals between the stopping of the driving of the motor 72 is extended. As for the phenomenon that the development sleeve fails to be fully coated with the developer, it occurred when the intervals with which the motor 72 is stopped was set to no less than 500 sheets of recording medium. On the other hand, the shorter the intervals with which the driving of the motor 72 is stopped, the less it is for the stationary layer of developer to be formed. However, reducing the intervals with which the driving of the motor 72 is stopped increases the frequency with which the image forming operation is interrupted. Therefore, it reduces the image forming apparatus in productivity. In particular, the interval is set to no more than 100 sheets of recording medium, the image forming apparatus drastically increased in downtime. That is, it reduced in productivity. In this embodiment, therefore, the image forming apparatus is designed so that the CPU 71 determines whether or not the driving of the motor 72 is to be stopped, for every 200 sheets of recording medium. That is, as an image forming operation is continued for a length of time equivalent to 200 recording sheets of size A4 after the starting of the driving of the development sleeve 28, that is, as the length of time the development sleeve 28 is continuously driven reaches a preset value, the CPU 71 determines whether or not the current image forming operation is no more than a preset value (2%) in average image ratio.

Then, if the ongoing image forming operation is no more than 2% in average image ratio when the measured length of time the development sleeve 28 has been continuously rotated has become equivalent to the 200 recording sheets of size A4, the CPU 71 stops the motor 72 for a preset length of time. That is, the CPU 71 determines that it has become likely for stationary layers of developer to be formed in the developing device 4. Then, it temporarily widens the sheet interval, and stops the driving of the development sleeve 28 and developer conveying first and second screws 25 and 26 for a preset length of time (500 ms, for example).

In the following situation, the cumulative length of time the development sleeve 28 and developer conveying first and second screws 25 and 26 have been continuously rotated is reset to zero. That is, in a case where the average image ratio is no less than 2% when the length of the continuous driving of the motor 72 has reached the value equivalent to 200 recording sheets of size A4, or in a case where the job had been completed before the length of time the motor 72 has been continuously driven reached the value equivalent to 200 recording sheets of size A4, the storage for the measured length of time is reset to zero.

Figure 7:
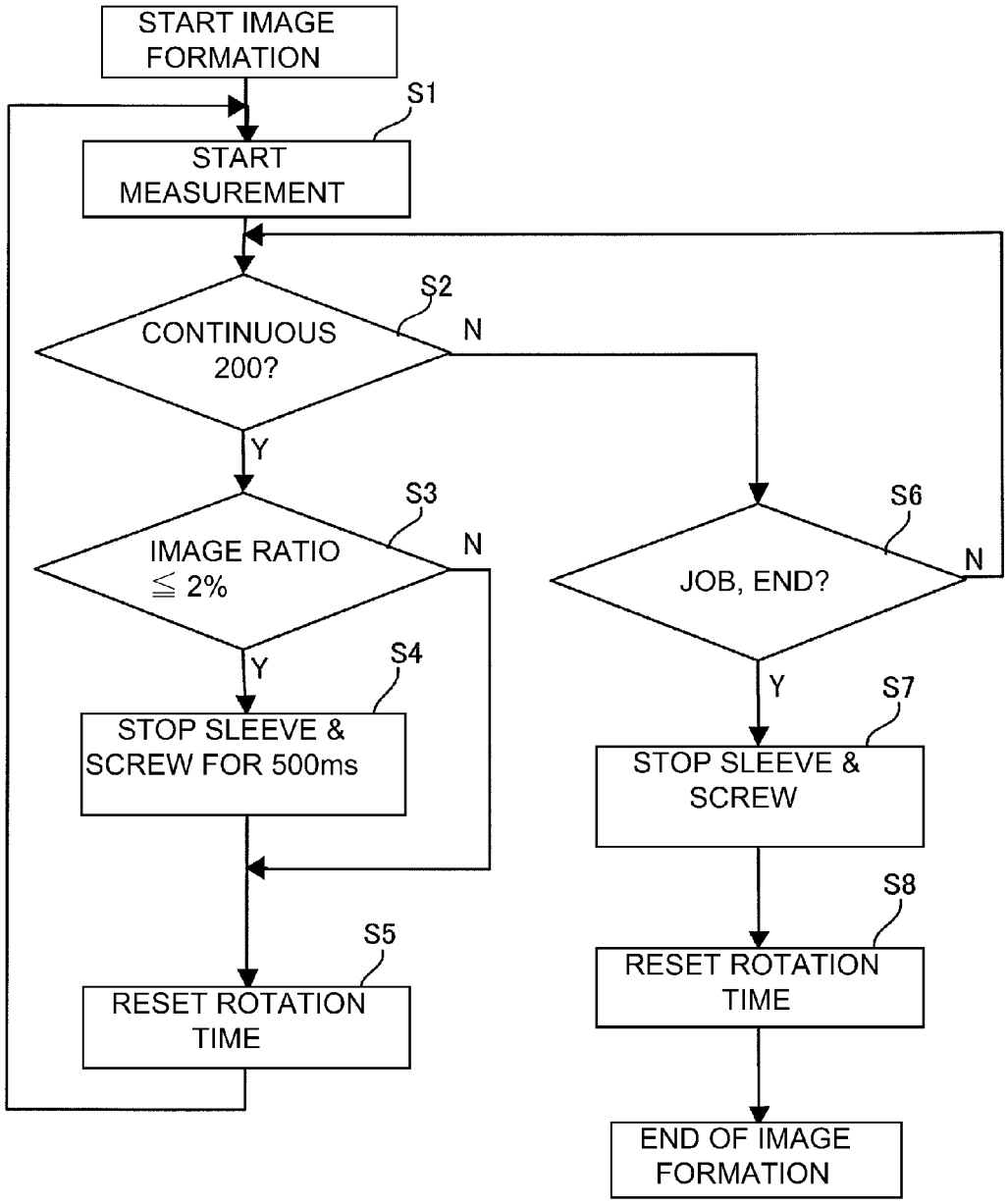
FIG. 7 is a flowchart of the control sequence of the image forming apparatus in the first preferred embodiment.

Next, referring to FIG. 7, the flow of the above-described control sequence in this embodiment is described. As soon as an image forming operation is started, the measuring section 71*a* of the control 71 begins to measure the length of time the development sleeve 28 is rotated (A1), and the control 71 determines whether or not the measured length of time has reached the value equivalent to 200 recording sheets of size A4 (S2). If the CPU 71 determines that the measured length of time has reached the value, it determines whether or not the average image ratio of the image forming operation, which has been successively calculated by the image ratio calculating section 71*b* is no more than 2% (S3). If the average image ration is no more than 2%, the CPU 71 stops the rotation of the development sleeve 28 and developer conveying first and second screws 25 and 26 by stopping the motor 72 (S4), and resets the storage for the length of the continuous rotation of the driving of the motor 72 measured by the measuring section 71*a* (S5). Then, the CPU 71 returns to S1. If the average image ratio is no less than 2% in S3, the CPU 71 resets the storage for the length of the continuous rotation of the motor 72 measured by the measuring section 71*a* (S5), and returns to S1 without stopping the motor 72.

On the other hand, if the length of the continuous rotation of the motor 72 has not reached the value equivalent to 200 recording sheets of size A4, the CPU 71 determines whether or not the job has been completed (S6). If it determines that the job has not been completed, it returns to S2. If it determines that the job has been completed, it stops the rotation of the development sleeve 28 and developer conveying first and second screws 25 and 26 by stopping the motor 72 (S7). Then, it resets the storage for the length of the continuous rotation of the motor 72 measured by the measuring section 71*a* (S8), and ends the image forming operation.

In this embodiment, therefore, while the developing device 4 is under the condition in which a stationary layer of developer is likely to be formed, the development sleeve 28 and developer conveying first and second screws 25 and 26 are not driven. More concretely, it is assumed that a stationary layer of developer is likely to be formed in a case where the average image ratio is no more than 2% after the development sleeve 28 is continuously rotated for a length of time equivalent to 200 recording sheets of size A4. Thus, as the image forming apparatus (developing device 4) falls under this condition, the CPU 71 stops driving the development sleeve 28 and developer conveying first and second screws 25 and 26 by stopping the motor 72. As described previously, as the driving of the development sleeve 28 and developer conveying first and second screws 25 and 26 is stopped, the top surface 8 of the body of developer in the developing device shell 22 lowers, making it less likely for a stationary layer of developer to be formed, compared to when the development sleeve 28 and developer conveying first and second screws 25 and 26 are being driven. Further, even if a stationary layer of developer is formed, it collapses as the driving of the development sleeve 28 and developer conveying first and second screws 25 and 26 stops. Therefore, the amount by which the developer in the developing device 4 is conveyed does not significantly reduces. Therefore, the image forming apparatus is unlikely to output a defective image, the defects of which are attributable to the reduction in the amount by which the developer is conveyed in the developing device.

Figure 15:
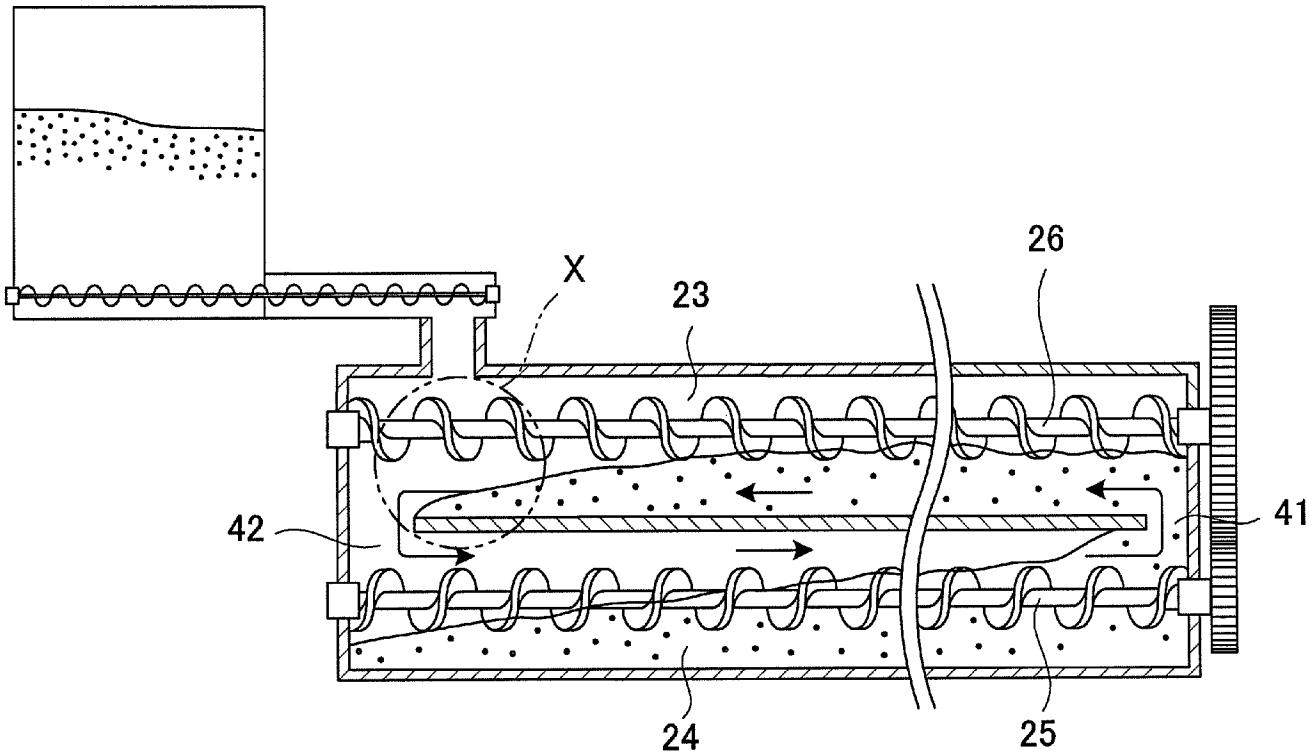
FIG. 15 is a vertical sectional view of the developing device of the so-called vertical circulation type, after the top surface of the body of developer in each of developer chambers of the device has changed in height.

In particular, the developing device 4 in this embodiment is structured so that the developer is vertically circulated between the two chambers 23 and 24 of the developing device 4. Thus, the top surface of the body of developer in each chamber is likely to become tilted relative to the developer conveyance direction as shown in FIG. 15. Therefore, as the amount by which the developer is conveyed in the developing device 4 reduces, the portion of the peripheral of the development sleeve 28, which corresponds to the area X in FIG. 15, is insufficiently supplied with the developer, which in turn is likely to cause this portion of the peripheral of the development sleeve 28 to fail to be fully coated with the developer. This embodiment, however, can prevent, as described above, the reduction in the amount by which the developer is conveyed in the developing device 4, and therefore, it can prevent the phenomenon that a part or parts of the peripheral of the development sleeve 28 fail to be coated with developer because of the reduction in the amount by which developer is conveyed in a developing device.

Incidentally, this embodiment is not intended to limit the present invention in terms of the timing with which the driving of the development sleeve and developer conveying first and second screws is stopped, average image ratio threshold value for determining whether or not the driving of the development sleeve and developer conveying first and second screws is to stopped, length of time the development sleeve and developer conveying first and second screws are to be temporarily kept stationary after being stopped. These parameters and values therefor should be adjusted according to the structure of the image forming apparatus (developing device) to which the present invention is applied, developer type, etc., in order to optimize the developing device in performance.

Further, in this embodiment, the driving of the development sleeve 28 and developer conveying first and second screws 25 and 26 is stopped with the preset intervals. However, the development sleeve 28 and developer conveying first and second screws 25 and 26 may be reduced in rotational speed with the preset intervals instead of being stopped. That is, as the preset condition is met after the development sleeve 28 begins to be rotated at a peripheral velocity at which an electrostatic latent image on the peripheral of the photosensitive drum 1 is developed, the motor 72 may be reduced in speed when the portion of the peripheral of the photosensitive drum 1, across which no image is to be formed (recording sheet interval), in the development area. As the motor 72 is reduced in speed, the development sleeve 28 and developer conveying first and second screws 25 and 26 reduce in speed, which in turns reduces the amount of force by which the developer in the developing device 4 is tossed by the fins of the developer conveying first and second screws 25 and 26 compared to when they are rotated at the normal speed for development. Thus, the top surface of the body of developer in each of the chambers 23 and 24 lowers. As a result, it becomes less likely for a stationary layer of developer to be formed as in a case where the motor 72 is stopped. Further, even if a stationary layer of developer is formed, it collapses.

Further, in this embodiment, the length of the continuous rotation of the development sleeve 28 is measured by the measuring section 71*a*. However, it may be calculated by counting the number of the continuous rotation of the development sleeve 28, for example, or the number of the images formed, instead of directly measuring the length of the continuous rotation of the development sleeve 28. In other words, there is no requirement pertaining to the means for obtaining the length of the continuous rotation of the development sleeve 28.

Further, in this embodiment, the amount by which the toner in the developing device 4 is consumed by the formation of a preset number of images is estimated based on the calculated average image ratio of the preset number of images. However, it may be estimated by totaling the image ratios of the preset number of images formed. In such a case, if the sum of the image ratios is no more than a preset value, it is determined that the amount of toner consumption was no more than a preset value, and the above-described control sequence is carried out.

Further, the amount by which the toner was consumed for the formation of a preset number of images can be indirectly measured by counting the number of times the developing device 4 is replenished with toner. For example, the average number of rotations of the developer conveying member 32 per preset length of time, or the total number of rotations of the developer conveying member 32 for the preset length of time, may be obtained. If the obtained average number of rotations or total number of rotations is no more than a preset value, it is to be determined that the amount of toner consumption was no more than a preset value, and the above-described control sequence is to be carried out. In essence, all that is necessary is that the amount of toner consumption can be obtained. That is, it does not matter what kind of means is used to obtain the amount of toner consumption.

Embodiment 2

Figure 8:
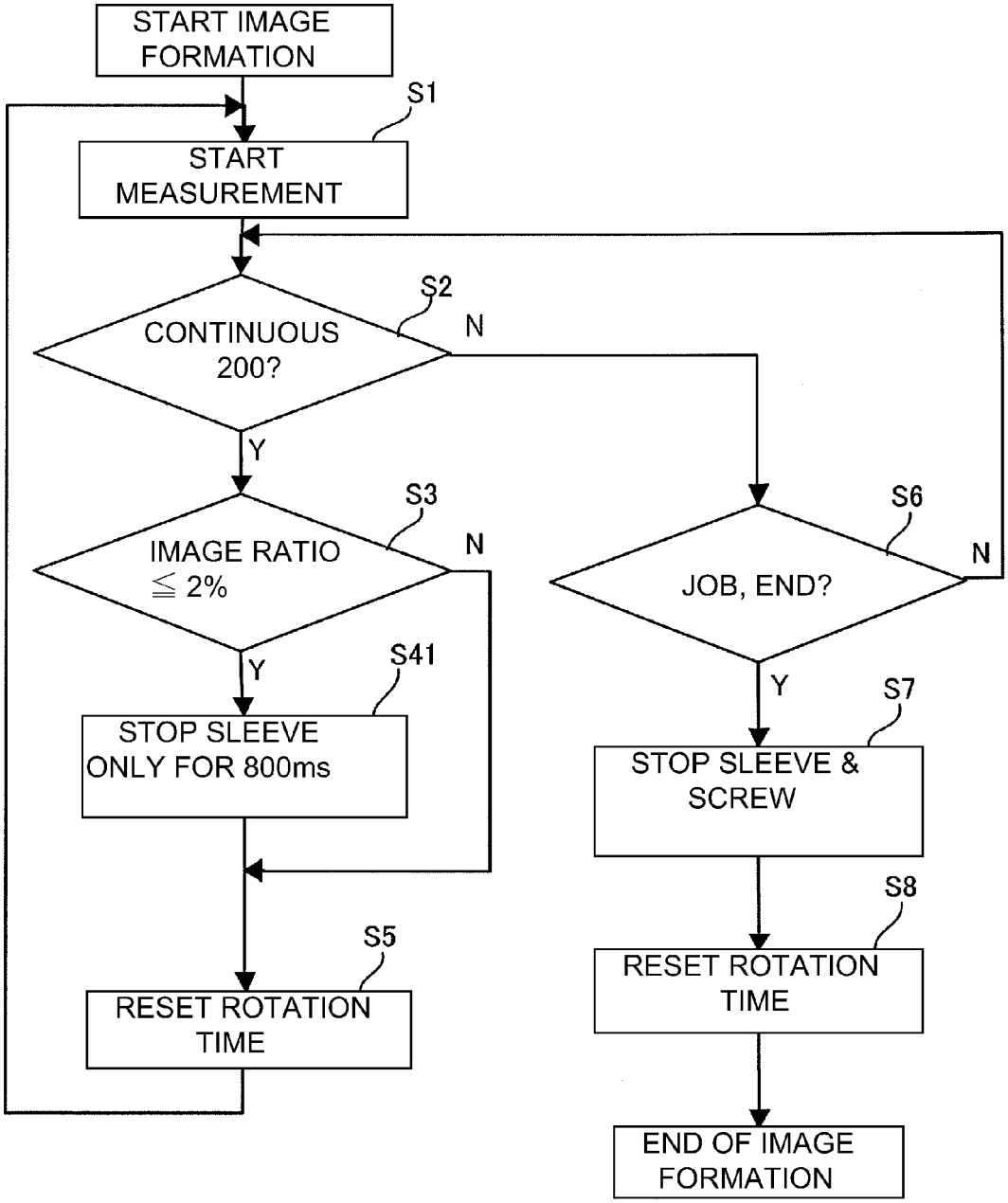
FIG. 8 is a flowchart of the control sequence of the image forming apparatus in the second preferred embodiment of the present invention.
Figure 9:
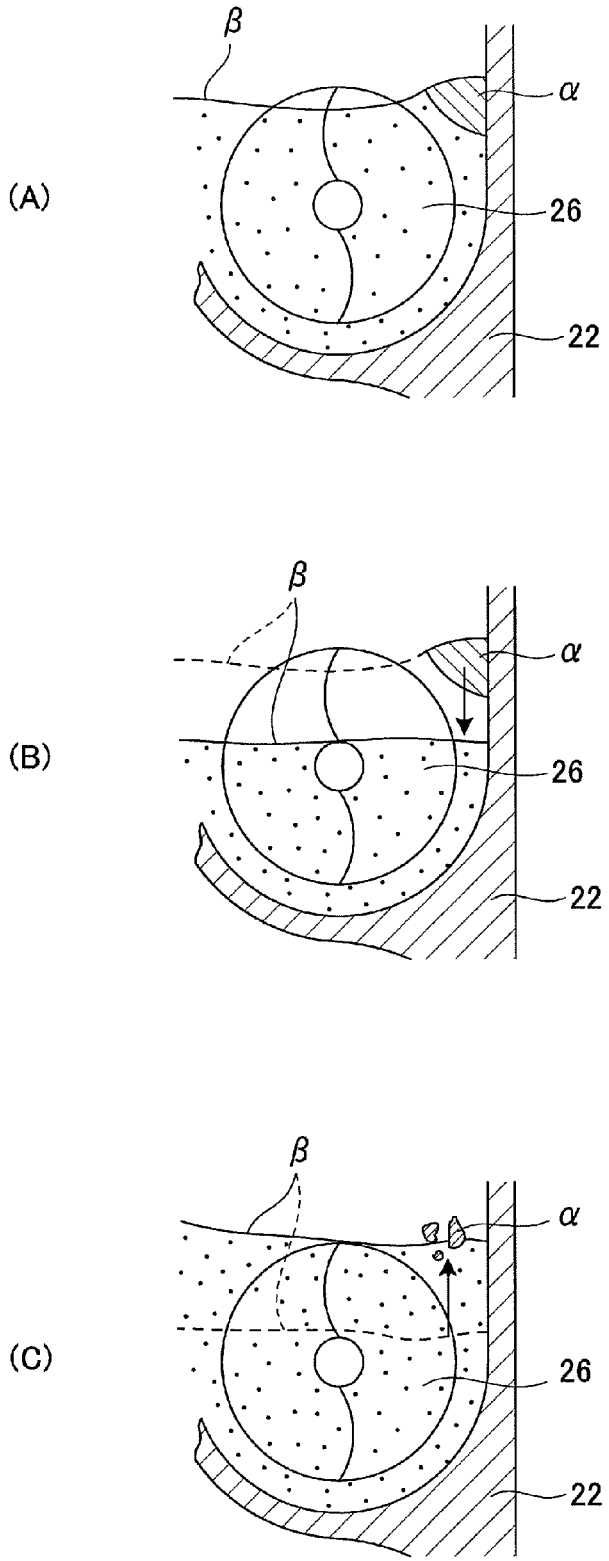
FIGS. 9(*a*), 9(*b*), and 9(*c*) are enlarged vertical sectional views of the developing device in the second preferred embodiment, at a vertical plane perpendicular to the lengthwise direction of the device. They show the changes which occur to the surface of the body of developer in the developing device when the developing device is controlled following the control sequence in the second preferred embodiment.

Next, referring to FIGS. 8 and 9, along with FIGS. 1-4, the second preferred embodiment of the present invention is described. The structure and control of the image forming apparatus (developing device) in this embodiment are roughly the same as those in the first embodiment described above, except the following features. That is, in this embodiment, the motor by which the development sleeve 28 is driven is different from the motor by which the developer conveying first and second screws 25 and 26 are driven.

Further, in this embodiment, as the condition similar to that in the first embodiment is met, the CPU 71 stops the driving of the development sleeve 28, or slows the development sleeve 28, when the image-free area of the peripheral of the photosensitive drum 1 is in the development area. As for the speeds of the developer conveying first and second screws 25 and 26, they are kept the same. That is, the motor for driving the developer conveying first and second screws 25 and 26 are kept the same in speed, whereas the motor for driving the development sleeve 28 is stopped or reduced in speed.

Next, referring to FIG. 8, the control sequence carried out by the CPU in this embodiment is described. FIG. 8 is a flowchart of the control sequence for the developing device 4 in this embodiment. Incidentally, the structural arrangement and control sequence for measuring the length of time the motor for driving the development sleeve 28 is continuously driven after the starting of an image forming operation, and the structural arrangement and control sequence for calculating the average image ratio of the prints formed prior to the stopping of the motor for driving the development sleeve 28, are the same as those in the first embodiment. In this embodiment, as the length of continuous rotation of the development sleeve 28 reaches a value equivalent to 200 recording sheets of size A4 (S2), and the average image ratio of the ongoing image formation up to this point in time is no more than 2% (S3), the CPU 41 widens the recording sheet interval, and stops the motor for driving the development sleeve 28, for 800 ms, without changing in rotational speed the motor for driving the developer conveying first and second screws (S41). Otherwise, the flow of the control sequence in this embodiment is the same as that in the first embodiment.

Next, referring to FIG. 9, the effects of the control sequence in this embodiment are described. FIG. 9 shows the changes, in terms of the position and state, which occurs to the top surface β of the body of developer in the developing device 4, in the adjacencies of the developer passage 41, which is highest in the position of the top surface β. The developer passage 41 is the passage through which the developer is pushed up into the development chamber 23 from the stirring chamber 24 as indicated by an arrow mark in FIG. 3. In the case of a developing device of the vertical circulation type, the developer passage 41 corresponds to the highest area of the top surface β.

As an image forming operation for forming multiple images which are low in average image ratio are continued after the developer in the developing device reduced in fluidity, it becomes likely for a stationary layer α of developer to be formed between the developer conveying screw 26 and the external wall of the developing device shell 22, in the area which is larger in distance between the developer conveying screws 26 and the wall as shown in FIG. 9(A). As the rotation of the development sleeve 28 is stopped without changing the rotational speed of the developer conveying screw 26 after the formation of a stationary layer α of developer, the surface β temporarily lowers, as shown in FIG. 9(B), (from position indicated by broken line to position indicated by solid line), making it easier for the stationary layer α of developer to collapse, for the following reason. That is, right after the stopping of the rotation of the development sleeve 28, no developer is sent by the development sleeve 28 from the development chamber 23 to the stirring chamber 24. Therefore, the stirring chamber 24 temporarily reduces in the amount of developer. As a result, the portion of the stirring chamber 24, which is in the adjacencies of the developer passage 41, that is, the upward developer passage, also reduces in the amount of developer. Then, as the stirring chamber 24 recovers in the amount of developer, the surface β rises (from position indicated by broken line to position indicated by solid line) as shown in FIG. 9(C), and pushes upward a part of the remaining portion of the stationary layer α of developer, causing thereby the remaining portion of the stationary layer α of developer to collapse. Thus, this embodiment is more effective than the first embodiment in terms of the prevention of the formation of a stationary layer of developer, and collapsing of a stationary layer α of developer. Otherwise, this embodiment is the same as the first embodiment.

Incidentally, in this embodiment, the driving of the development sleeve is stopped with preset intervals without changing the developer conveying screws in rotational speed. However, the development sleeve may be slowed in rotational speed compared to its normal speed for development, instead of being stopped. Further, not only the development sleeve, but also, the developer conveying screws may be reduced in rotational speed compared to their normal speeds for development. The effects of such a control sequence are the same as those in this embodiment.

Embodiment 3

Figure 10:
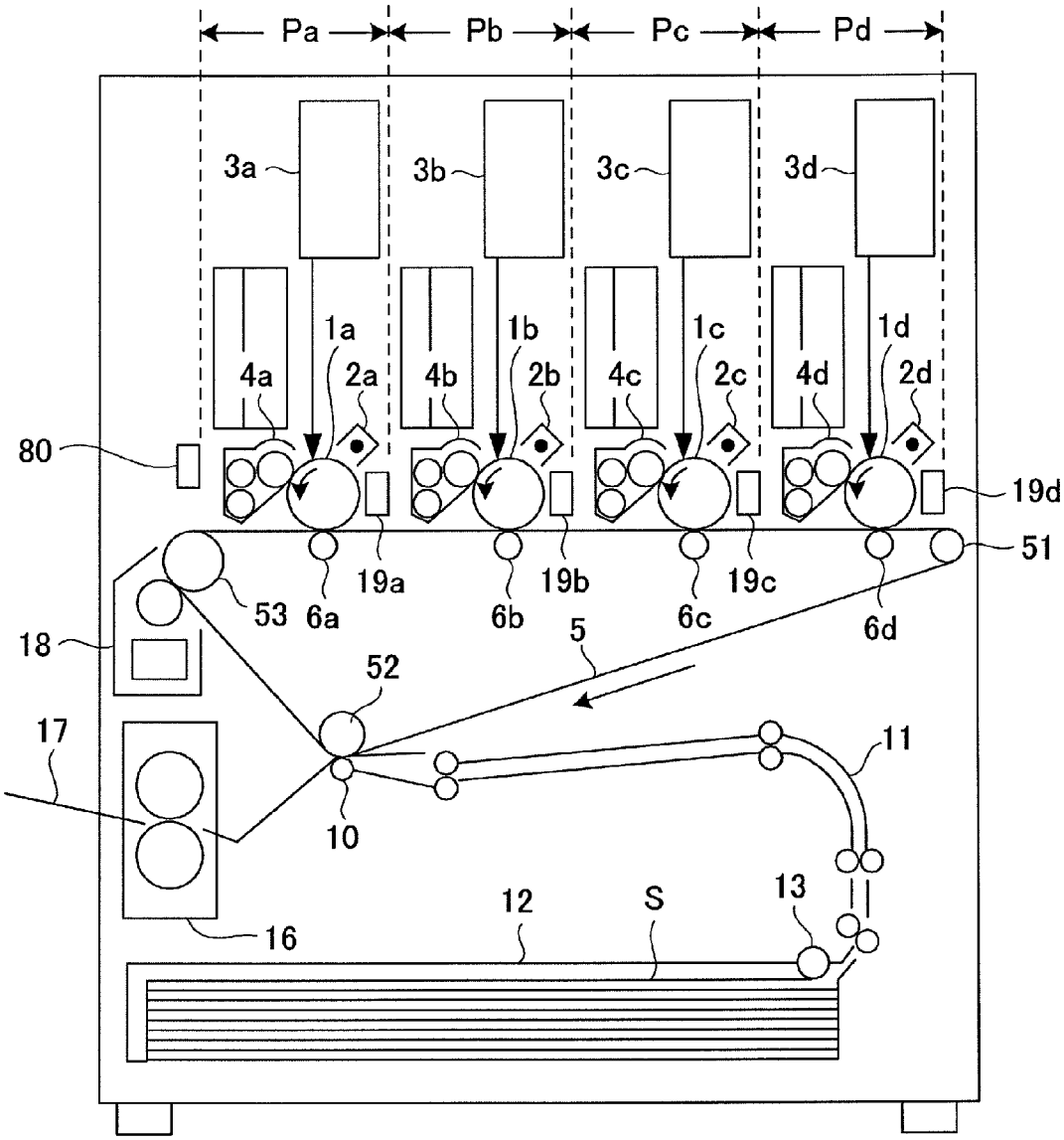
FIG. 10 is a schematic sectional view of the image forming apparatus in the third preferred embodiment of the present invention. It describes the general structure of the apparatus.
Figure 11:
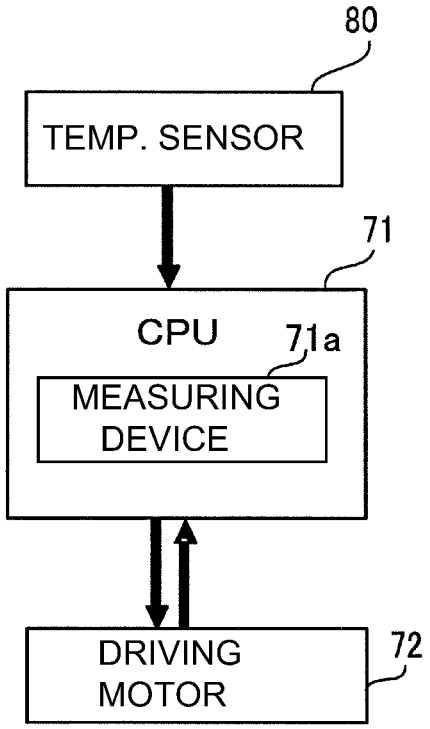
FIG. 11 is a block diagram of the developing device controlling section of the image forming apparatus.

Next, referring to FIGS. 10-13, along with FIGS. 2 and 3, the third preferred embodiment of the present invention is described. The structure and control sequence of the image forming apparatus (developing device) in this embodiment are virtually the same as those in the above-described first embodiment, except that the developing device in this embodiment has a temperature sensor 80 as a temperature detecting means for detecting the ambient temperature of the developing device 4, as shown in FIG. 10. The developing device 4 in this embodiment is controlled in response to the ambient temperature of the developing device 4 detected by the temperature sensor 80. Hereafter, the control sequence in this embodiment is described with reference to the block diagram in FIG. 11, and the flowchart in FIG. 12.

Also in this embodiment, as soon as an image forming operation is started, the length of the continuous rotation of the motor for driving the development sleeve 28 and developer conveying screws 25 and 26 begins to be measured as in the first embodiment. As for the parameter for determining the fluidity of the developer, the ambient temperature of the developing device detected by the temperature sensor 80 positioned in the adjacencies of the developing device is used. That is, as soon as the CPU 71 begins to continuously rotate the development sleeve 28 at the normal speed for development, it begins to monitor the developing device 4 to find out whether or not the ambient temperature of the developing device 4 detected by the temperature sensor 80 is no less than a preset level. Then, as soon as the ambient temperature of the developing device 4 reaches the preset level, it stops the motor 72.

Figure 13:
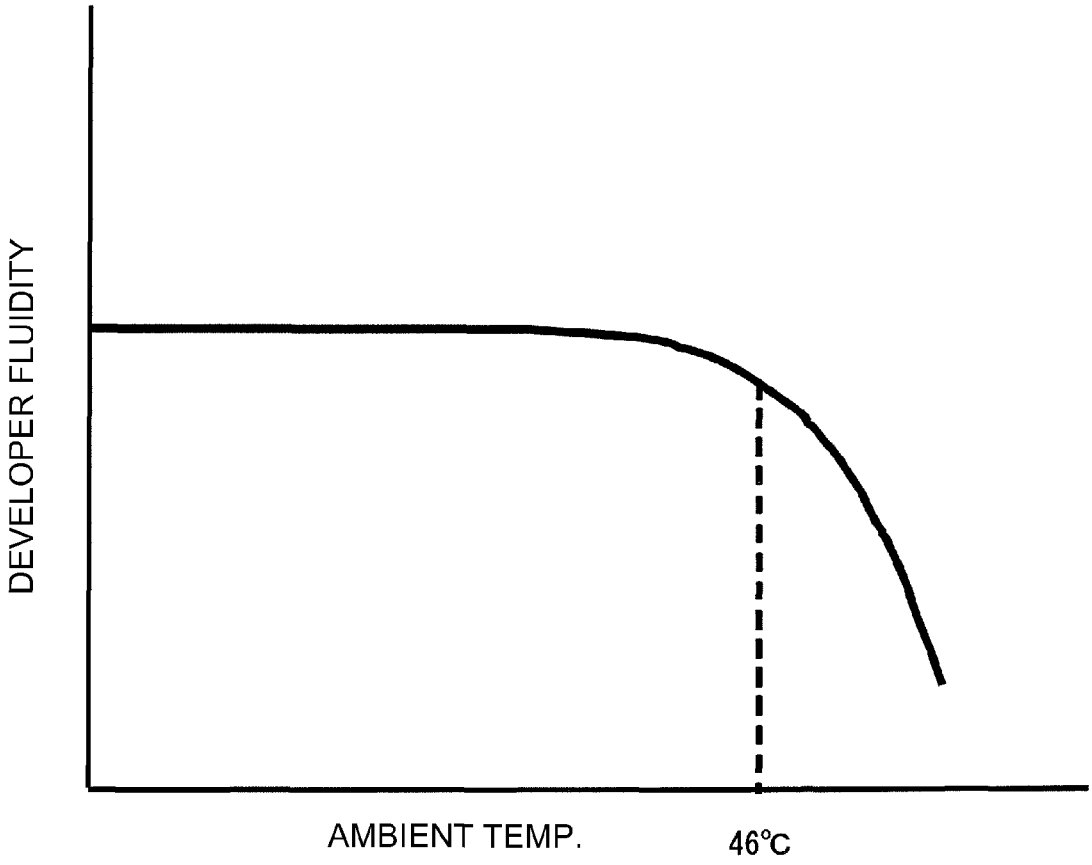
FIG. 13 is a graph which shows the relationship between the ambient temperature of the developing device and the fluidity of the developer in the developing device.
Figure 14:
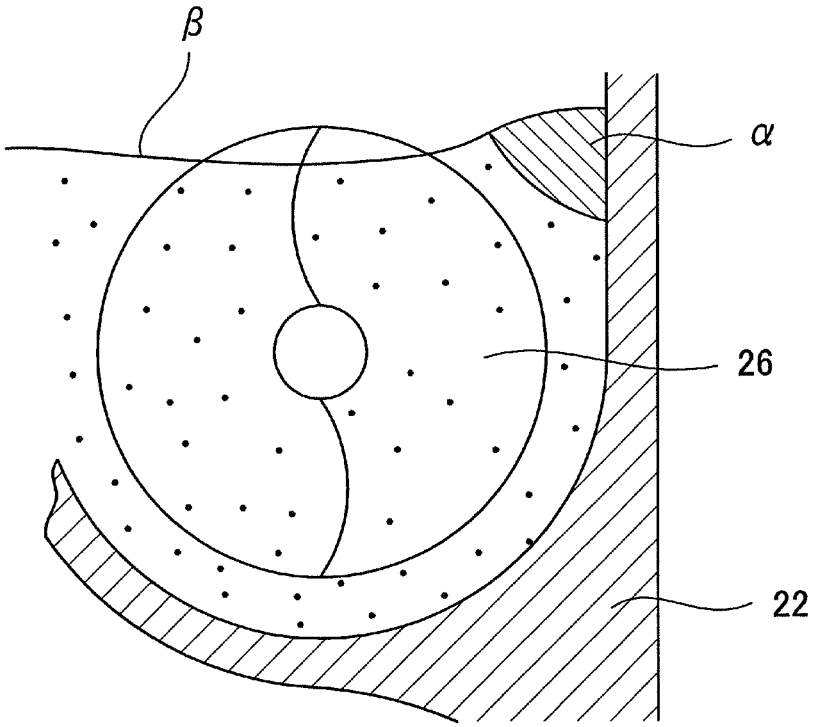
FIG. 14 is an enlarged sectional view of a part of the developing device at a vertical plane perpendicular to the lengthwise direction of the device. It is for describing the stationary layer of developer in the device.

As described above, the higher the ambient temperature of the developing device 4 becomes, the lower the developer becomes in fluidity. In the case of the developing device and developer used in this embodiment, as their ambient temperatures become higher than 46° C., the developer drastically reduces in fluidity. If the ongoing image forming operation is continued under this condition, that is, when the developer is lower in fluidity than a certain level, it was likely for a stationary layer of developer to form. The relationship between the ambient temperature of the developing device 4 and the fluidity of the developer in the developing device 4 is shown in FIG. 13.

Figure 12:
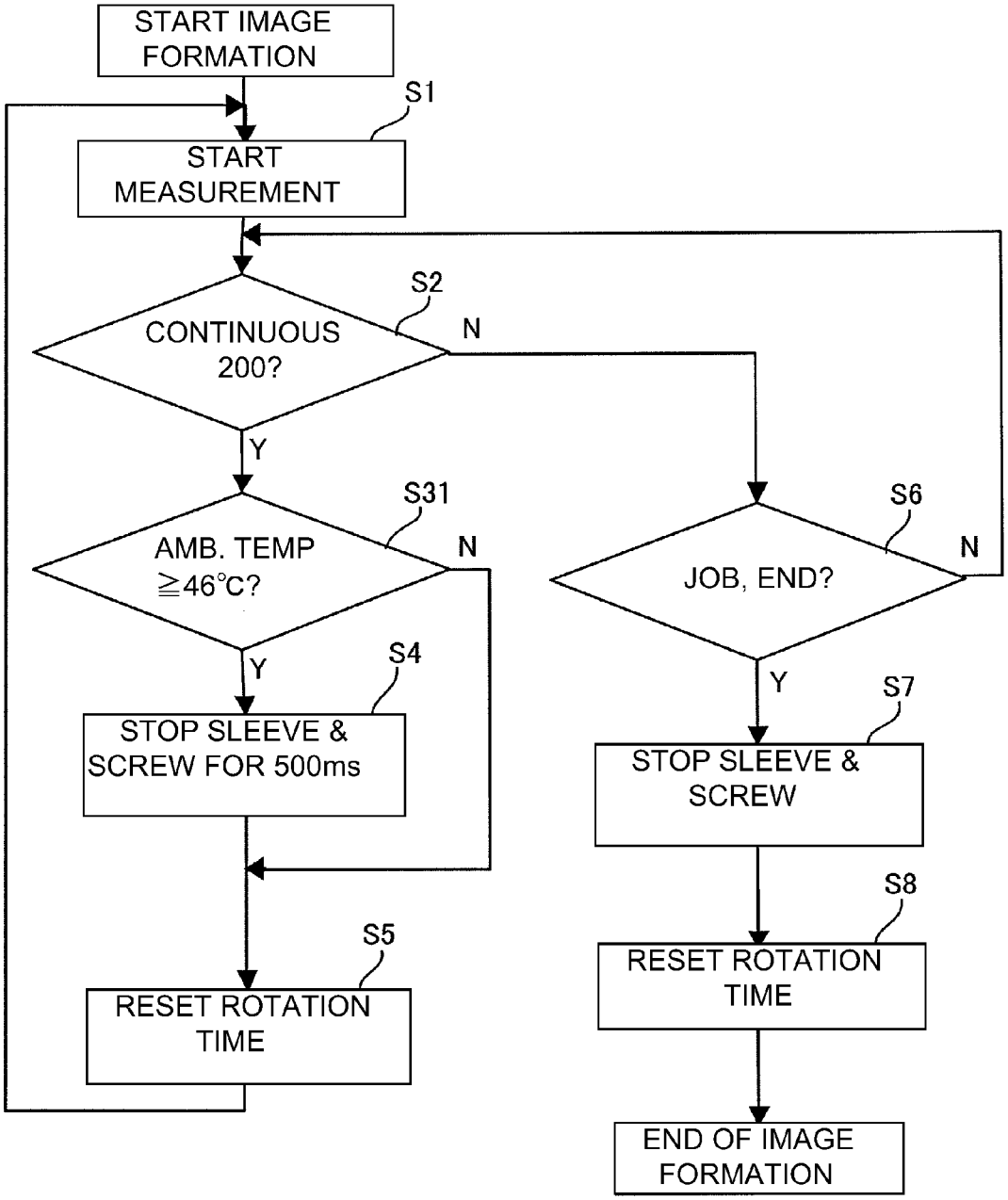
FIG. 12 is a flowchart of the control sequence for the image forming apparatus in the third preferred embodiment.

Referring to FIG. 12, as the CPU detects that the measured length of the continuous rotation of the motor 72 has reached the value equivalent to 200 recording sheets of size A4 (S2), it obtains the ambient temperature of the developing device 4 from the temperature sensor 80 (S3). If the ambient temperature is no less than 46° C., it determines that the developing device 4 is in the condition in which a stationary layer of developer is likely to be formed in the developing device 4. Then, it makes the recording sheet interval wider than the normal one, and stops the motor 72 for driving the development sleeve and developer conveying screws for 500 ms (S4). Otherwise, the flow of the control sequence in this embodiment is the same as that in the first embodiment. That is, the formation of a stationary layer of developer can be prevented also by using the method in this embodiment for controlling the driving of the motor for driving the development sleeve and developer conveying screws.

In this embodiment, if the following condition occurs, the storage for the value of the length of the continuous rotation of the development sleeve 28, and the storage for the value of the length of the continuous rotation of the developer conveying screws 25 and 26, are reset to zero. That is, in a case where the ambient temperature of the developing device 4 is no more than 46° C., or the job had been completed, when the length of the continuous rotation of the motor 72 has reached the value equivalent to 200 recording sheets of size A4, the storage for the value of the length of the continuous rotation of the motor 72 is reset. Otherwise, this embodiment is the same as the first embodiment in terms of the structure and control sequence of the image forming apparatus (developing device).

Incidentally, in this embodiment, the driving of the development sleeve and developer conveying screws is stopped based on the length of the continuous rotation of the development sleeve and developer conveying screws, and the ambient temperature of the developing device 4. However, the image forming apparatus and its developing device may be controlled based on three parameters, that is, the two parameters in this embodiment, and the average image ratio, that is, the parameter used in the first embodiment. Further, the control sequence in this embodiment, which is based on three parameters, may be used with a structural arrangement such as the one in the second embodiment. Further, as the condition in which a stationary layer of developer is likely to form, a parameter such as humidity, for example, may be taken into consideration.

In the preceding embodiments of the present invention, which were presented to concretely describe the present invention, the developing device was of the so-called vertical developer circulation type. That is, the developing device had the development chamber 23 and stirring chamber 24, which were vertically stacked. However, these embodiments are not intended to limit the present invention in terms of the developing device structure. That is, the present invention is applicable to a developing device, of which development chamber for supplying the development sleeve with developer, and stirring chamber for recovering developer from the development sleeve, are positioned side by side.

Also in the preceding embodiments, the body of developer in each of the two developer chamber in the developing device shell was changed in height by stopping at least one among the development sleeve 28 and developer conveying first and second screws 25 and 26. However, these embodiments are not intended to limit the present invention in terms of the control of these components. For example, the present invention is also compatible with a control sequence which increases at least one among the development sleeve 28 and developer conveying first and second screws 25 and 26 in rotational speed compared to their normal speeds for development. However, in consideration of the effects of the change in the rotational speeds of these components upon developer deterioration and collapsing of a stationary layer of developer, it is preferable to temporarily stop the driving of these components, or temporarily slow these components.

Further, in the preceding embodiments, the developing devices were structured and controlled so that as the CPU detects that the length of the continuous rotation of the motor for driving the development sleeve has reached the value equivalent to 200 recording sheets of size A4, it determines whether or not the image forming apparatus and its developing device are to be operated in the mode in which the motor 72 for driving the development sleeve 28, and/or motor for driving the developer conveying first and second screws 25 and 26 are stopped. However, these embodiments are not intended to limit the present invention in terms of the structure and control of the image forming apparatus and its developing device. For example, the present invention is applicable to an image forming apparatus and its developing device structured and controlled so that the image forming apparatus and its developing device are operated in the above-described mode each time the length of the continuous rotation of the development sleeve 28 reaches the preset value, and the frequency with which the apparatus is operated in this mode is changed according to the average image ratio and/or the ambient temperature of the developing device. The effects of the application of the present invention to the image forming apparatus and its developing device structured and controlled as described are the same as those obtainable by the image forming apparatuses and their developing devices in the preceding embodiments. In such a case, the image forming apparatus and its developing device may be structured and controlled so that when an image forming operation is low in average print (image) ratio and/or the ambient temperature of the developing device is high, the apparatus is increased in the frequency with which the apparatus is operated in the above-described mode (apparatus is increased in interval with which it is operated in above-described mode).

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 212313/2010 filed Sep. 22, 2010 which is hereby incorporated by reference.

What is claimed is:

1. An image forming apparatus comprising:

an image bearing member for bearing an image;

a developer carrying member for carrying a developer containing toner to a developing position where said developer carrying member is opposed to said image bearing member to develop a latent image formed on said image bearing member;

a first accommodating portion for containing the developer and for supplying the developer to said developer carrying member at a first position opposing said developer carrying member;

a second accommodating portion for collecting the developer from said developer carrying member at a position opposing said developer carrying member and for containing the developer, said second accommodating portion communicating with said first accommodating portion to form a circulation path and being provided upstream of said first accommodating portion with respect to a rotational moving direction of said developer carrying member;

a first feeding member for feeding the developer in said first accommodating portion;

a second feeding member for feeding the developer in said second accommodating portion;

an acquiring portion for acquiring information relating to a consumption amount of the toner; and a controller for executing, during an execution of an image formation job in which an image forming operation is carried out continuously on a plurality of recording materials, an operation in a mode in which said developer carrying member is stopped while driving said first feeding member and said second feeding member wherein said controller determines whether to execute the operation on the basis of pieces of information which are acquired at predetermined intervals within a predetermined period by said acquiring portion.

2. An apparatus according to claim 1, wherein the information is an average image ratio, and an execution frequency of the mode is relatively higher when the average image ratio is relatively lower.

3. An apparatus according to claim 1, wherein said first container is disposed above said second container.

4. An apparatus according to claim 1, wherein during the operation in the mode, speeds of said first and second feeding members are the same as speeds during the image forming operation.

5. An apparatus according to claim 1, wherein said controller reduces an amount of the developer in said second accommodating portion by the operation in the mode.

6. An apparatus according to claim 1, wherein said first accommodating portion and said second accommodating portion are disposed at different levels.

7. An apparatus according to claim 1, further comprising a temperature detecting portion, wherein an execution frequency of the mode is relatively higher when the temperature detected by said temperature detecting portion is relatively higher.

8. An apparatus according to claim 1, wherein the predetermined period corresponds to a first number of the recording materials, and the predetermined intervals correspond to a second number of the recording materials, wherein the second number is smaller than the first number.

9. An apparatus according to claim 1, wherein the predetermined intervals correspond to a predetermined driving time period.

10. An image forming apparatus comprising:

an image bearing member for carrying an image;

a developer carrying member for carrying a developer containing toner to a developing position where said developer carrying member is opposed to said image bearing member to develop a latent image formed on said image bearing member;

a first accommodating portion for containing the developer and for supplying the developer to said developer carrying member at a position opposing said developer carrying member;

a second accommodating portion for collecting the developer from said developer carrying member at a position opposing said developer carrying member and for containing the developer, said second accommodating portion communicating with said first accommodating portion to form a circulation path and being provided upstream of said first accommodating portion with respect to a rotational moving direction of said developer carrying member;

a first feeding member for feeding the developer in said first accommodating portion;

a second feeding member for feeding the developer in said second accommodating portion;

an acquiring portion for acquiring information relating to a consumption amount of the toner; and a controller for executing, during an execution of an image formation job in which an image forming operation is carried out continuously on a plurality of recording materials, an operation in a mode in which ratios of a speed of said developer carrying member to a speed of said first feeding member and a speed of said second feeding member are made different from those during a period in which the image passes in the developing position, in the period in which a portion between an image and a subsequent image passes in the developing position wherein said controller determines whether to execute the operation on the basis of pieces of information which are acquired at predetermined intervals within a predetermined period by said acquiring portion.

11. An apparatus according to claim 10, wherein during the execution of the mode, ratios of a speed of said developer carrying member to a speed of said first feeding member and a speed of said second feeding member are made smaller than those during a period in which the image passes in the developing position, in the period in which a portion between an image and a subsequent image passes in the developing position.

12. An apparatus according to claim 10, wherein the predetermined period corresponds to a first number of the recording materials, and the predetermined intervals correspond to a second number of the recording materials, wherein the second number is smaller than the first number.

13. An apparatus according to claim 10, wherein the predetermined intervals correspond to a predetermined driving time period.

14. An image forming apparatus comprising:

an image bearing member for carrying an image;

a developer carrying member for carrying a developer containing toner to a developing position where said developer carrying member is opposed to said image bearing member to develop a latent image formed on said image bearing member;

a first accommodating portion for containing the developer and for supplying the developer to said developer carrying member at a position opposing said developer carrying member;

a second accommodating portion for collecting the developer from said developer carrying member at a position opposing said developer carrying member and for containing the developer, said second accommodating portion communicating with said first accommodating portion to form a circulation path and being provided upstream of said first accommodating portion with respect to a rotational moving direction of said developer carrying member;

a first feeding member for feeding the developer in said first accommodating portion;

a second feeding member for feeding the developer in said second accommodating portion;

an acquiring portion for acquiring information relating to a consumption amount of the toner;

a controller for executing, during an execution of an image formation job in which an image forming operation is carried out continuously on a plurality of recording materials, an operation in a mode in which said developer carrying member is stopped while driving said first feeding member and said second feeding member;

wherein said controller determines whether to execute the operation on the basis of accumulated information acquired by said acquiring portion.

15. An apparatus according to claim 14, wherein the accumulated information is acquired by said acquiring portion for every predetermined number of recording materials or for every predetermined duration in the predetermined driving time period.

16. An image forming apparatus comprising:

an image bearing member for carrying an image;

a developer carrying member for carrying a developer containing toner to a developing position where said developer carrying member is opposed to said image bearing member to develop a latent image formed on said image bearing member;

a first accommodating portion for containing the developer and for supplying the developer to said developer carrying member at a position opposing said developer carrying member;

a second accommodating portion for collecting the developer from said developer carrying member at a position opposing said developer carrying member and for containing the developer, said second accommodating portion communicating with said first accommodating portion to form a circulation path and being provided upstream of said first accommodating portion with respect to a rotational moving direction of said developer carrying member;

a first feeding member for feeding the developer in said first accommodating portion;

a second feeding member for feeding the developer in said second accommodating portion;

an acquiring portion for acquiring information relating to a consumption amount of the toner; and a controller for executing, during an execution of an image formation job in which image forming operation is carried out continuously on a plurality of recording materials, an operation in a mode in which ratios of a speed of said developer carrying member to a speed of said first feeding member and a speed of said second feeding member are made different from those during a period in which the image passes in the developing position, in the period in which a portion between an image and a subsequent image passes in the developing position, wherein said controller determines whether to execute the operation on the basis of accumulated information acquired by said acquiring portion.

17. An apparatus according to claim 16, wherein the accumulated information is acquired by said acquiring portion for every predetermined number of recording materials or for every predetermined duration in the predetermined driving time period.

* * * * *